United States Patent [19]

Kashiwa

[11] Patent Number: 4,858,945

[45] Date of Patent: Aug. 22, 1989

[54] SNOW SKI AND METHOD OF MAKING THE SAME

[76] Inventor: Bryan A. Kashiwa, 1896 Camino Manzana, Los Alamos, N. Mex. 97544

[21] Appl. No.: 939,186

[22] Filed: Dec. 8, 1986

Related U.S. Application Data

[63] Continuation-in-part of Ser. No. 720,878, Apr. 8, 1985, abandoned, which is a continuation-in-part of Ser. No. 675,011, Nov. 26, 1984, abandoned, which is a continuation of Ser. No. 412,024, Aug. 26, 1982, abandoned.

[51] Int. Cl.[4] ..... A63C 5/00

[52] U.S. Cl. ..... 280/610; 428/192; 428/220; 428/332; 428/337; 428/464; 428/537.1

[58] Field of Search ..... 280/610; 428/220, 192, 428/332, 337, 537.1, 464

[56] References Cited

U.S. PATENT DOCUMENTS

| | | | |
|---|---|---|---|
| 2,158,325 | 5/1939 | Hunt | 280/610 |
| 2,264,535 | 12/1941 | Vilemm | 210/610 |
| 2,434,851 | 1/1948 | Hoerle | 280/610 |
| 2,446,591 | 8/1948 | Hoerle | 280/610 |
| 2,851,277 | 9/1958 | Holmberg et al. | 280/610 |
| 3,194,572 | 7/1965 | Fischer | 280/610 |
| 3,352,566 | 11/1967 | Kennedy | 428/116 |

FOREIGN PATENT DOCUMENTS

| | | | |
|---|---|---|---|
| 2157045 | 5/1973 | Fed. Rep. of Germany | 280/610 |
| 2317046 | 10/1974 | Fed. Rep. of Germany | 280/610 |
| 2461213 | 6/1976 | Fed. Rep. of Germany | 280/610 |
| 273982 | 3/1951 | Switzerland | 280/610 |
| 635823 | 4/1950 | United Kingdom | 280/610 |

*Primary Examiner*—Ellis P. Robinson
*Attorney, Agent, or Firm*—Hughes & Multer

[57] ABSTRACT

A ski having an outer structure made of high strength steel. There is an upper steel sheet having a U-shaped cross-sectional configuration and a lower planar steel sheet. A wood core is positioned between and bonded to the upper and lower steel sheets. Two steel edge members have inwardly and laterally extending flanges which are bonded to the lower steel sheet, and a running surface member is bonded to the lower surface of the lower steel sheet. In the method of the present invention, the lower steel sheet, the running surface member and the edge members are placed in a receiving area defined by a fixture having two side rails, with the rails aligning these components. The core and the upper sheet are placed onto the lower steel sheet, with the edge members having alignment surfaces locating the components relative to one another. This forms a prebonded assembly which is later placed in a laminating fixture to form the finished ski.

21 Claims, 10 Drawing Sheets

PREFERRED EMBODIMENT

PRE-ASSEMBLY PROCESS

EDGE DETAIL

A SECOND EMBODIMENT

A THIRD EMBODIMENT

FLEXURAL STIFFNESS VS. THICKNESS

WEIGHT DENSITY VS. FLEXURAL STIFFNESS

FIG. 14

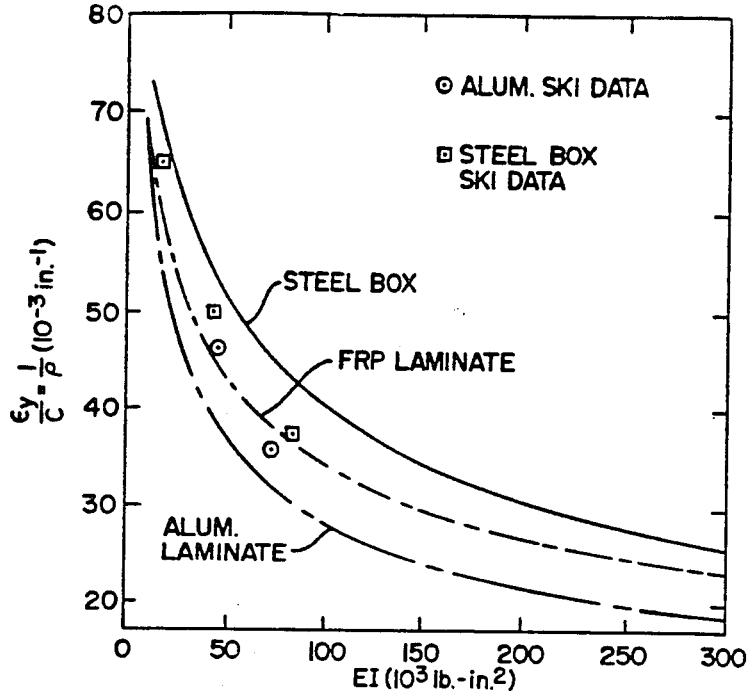

YIELD STRENGTH VS. STIFFNESS

FIG. 15

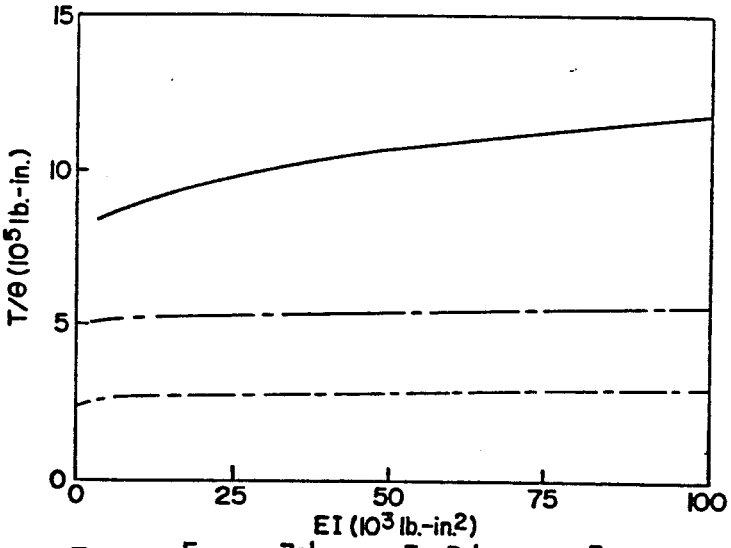

$$\frac{T}{\theta} = B_t^2 \frac{G}{L}\left[\frac{W}{t_1} + \frac{W}{t_2}\right]^{-1} + B_s^2 \frac{G}{L}\left[\frac{2h}{t_3}\right]^{-1}$$

$$B_t = \frac{W}{2}(W^2+h^2)^{1/2} + \frac{h^2}{2}\,\mathrm{SIN}\,h^{-1}\left(\frac{W}{h}\right)$$

$$B_s = \frac{h}{2}(h^2+W^2)^{1/2} + \frac{W^2}{2}\,\mathrm{SIN}\,h^{-1}\left(\frac{h}{W}\right)$$

$$\left[\begin{array}{l} G_{AL} = 4\times10^6\,\mathrm{psi} \\ G_{STEEL} = 12\times10^6\,\mathrm{psi} \\ G_{FRP} = 2\times10^6\,\mathrm{psi} \end{array}\right]$$

W - WIDTH (3in)

$t_1, t_2, t_3$ ARE THICKNESS PER FIG. 6

$$\frac{1}{\rho} = \mathrm{MIN}\left(\frac{\epsilon_f}{c}, \frac{\epsilon_s}{h-c}\right); \epsilon = \frac{\sigma}{E}$$

SNOW SKI AND METHOD OF MAKING THE SAME

CROSS-REFERENCE TO RELATED APPLICATIONS

This application claims the priority of PCT application, PCT/US 86/00721, filed Apr. 8, 1986, entitled, "SNOW SKI AND METHOD OF MAKING THE SAME", which is a continuation-in-part application of U.S. application Ser. No. 720,878, filed Apr. 8, 1985 now abandoned and having the same title.

This is a continuation-in-part application of U.S. patent application Ser. No. 720,878, filed Apr. 8, 1985, entitled "Snow Ski and Method of Making the Same", abandoned; which is in turn a continuation-in-part of U.S. patent application Ser. No. 675,011, filed Nov. 26, 1984, entitled "Metal Ski and Method Therefor"; which is in turn a continuation of U.S. patent application Ser. No. 412,024, filed Aug. 26, 1982 and entitled "Metal Ski and Method Therefor". Applications 412,024 and 675,011 have now been abandoned.

BACKGROUND OF THE INVENTION

1. Field of the Invention

The present invention relates to an improved alpine snow ski, and a method of making the same, effectively utilizing high strength steel or equivalent metallic material.

2. Background Art

Over the last several decades, the techniques in the design and manufacture of snow skis have undergone considerable improvement and become substantially more sophisticated. Prior to 1950, skis were commonly made of high quality wood, with metal edges being attached to the lower side edges of the ski to improved the turning capability of the ski without excessive slipping, particularly on an icy surface.

In the early 1950's, there was the introduction of a ski (manufactured by the Head Ski Company, U.S.A.) having a wood core to which were attached upper and lower aluminum sheets. While this design experienced a large degree of acceptance and provided many advantages over wooden skis, there were some shortcomings. One of these was that the design then available had excessive weight, making them more difficult to run than the wooden predecessors.

A ski of this general design is illustrated in U.S. Pat. No. 3,095,207, Head, where there is described a ski having upper and lower plates made of an aluminum alloy, and a core material made of plywood. In the particular configuration as shown in this patent, the edges of the ski are formed of steel strips that are placed in slits or grooves that are cut or milled in the lower aluminum alloy plate.

Accordingly, there were various design efforts to improve the performance of this aluminum sandwich ski, as described above, and one such approach was to add one or more rubber layers to the sandwich or laminations which made up the ski to dampen the vibrations.

In the early 1960s, skis utilizing fiber reinforced plastic as the main structural material made their appearance. One of the main advantages of this material is that it has very high strength, both in compression and in tension, relative to the density (i.e. weight per unit of volume) of the material. The earlier designs were in the nature of a laminated structure, where there was a sandwich of fiber reinforced plastic and high quality wood.

At a later time (i.e. around the mid 1960's or shortly thereafter), skis having a box-like structure made of fiber reinforced plastic became more prevalent. Also, during approximately that same time period, skis having a honeycomb core structure made their appearance.

The introduction of the foregoing "aerospace" material into ski designs was motivated by the desire to create a ski of lower weight than the Head-type aluminum laminated skis, and thereby improve the turning properties of the ski.

As we approach present day ski designs, it appears that the evolution of the design of skis has been such that many earlier designs have, in a structural sense, given way to only a few current designs. Further, the design parameters have been channeled so that in terms of structural characteristics, the present day skis lie within a relatively narrow range of flexural stiffness, torsional stiffness, weight and strength. These have in a sense set the standards by which any new ski design must be measured.

Most any ski that is widely available today can be classified into one of three categories as to its principal structure: (a) aluminum sandwich structure, (b) fiber reinforced plastic, or (c) fiber reinforced plastic and aluminum combined. The wide variety of available models differs as to the type of core, edge and geometric design (i.e. side cut (contour) and stiffness distribution), but nonetheless, each model can be placed into one of the three groups. Despite the differences of core type and edge design within each group, there is a strong similarity in fundamental ski properties within each of the three groups. This is true largely because ski designs in the three groups have evolved to a point where a very narrow range of ski weight and stiffness is found to be acceptable to the ski market.

First, with regard to flexural stiffness, EI, where E is Young's modulus and I is the second area moment of the cross-section, this generally must lie within a range of about 5000–10,000 pound inches squared (lb-in$^2$) at the extreme ends, to about 250,000 lb-in$^2$ at the ski center (for a full length ski). The distribution of EI between these values varies with the type of service for which the ski is designed and determines to a large extent the "feel" of the ski.

Second, the torsional stiffness of the ski must be greater than a certain minimum. This is necessary so that the edge of the ski can hold to the underlying surface adequately when a turn is being executed.

Third, the weight of the ski should not be more than that of skis which are widely available at this time, these being the basic aluminum, fiber reinforced plastic, or combination of the two. This is primarily because both weight and flexural stiffness determine the dynamic response character of the ski, and since the allowable stiffness of skis is determined by skier weight and type of service, the ski weight is limited within a small range since the dynamic response expected by the market is largely predetermined.

Fourth, there is the necessary characteristic of basic durability, the most important part being resistance to permanent bending, called "yield strength".

In addition to the ski designs which have been manufactured commercially and found at least some degree of acceptance in the marketplace, there have been a large number of proposed designs, some of which have incorporated metal to form the main, or one of the main, structural elements. A number of these have appeared in the patent literature, and the following are noted as examples of these.

U.S. Pat. No. 1,552,990, Hunt, shows a ski that is made from sheet metal. The top sheet metal piece has two downwardly extending flanges, and these overlap with, and are soldered to, upwardly extending side flanges that are made integral with a bottom metal sheet. In some configurations, there are vertical webs or reinforcing members extending between the top and bottom sheets.

U.S. Pat. No. 2,038,077, Haglund, shows a ski where upper and lower strips of metal are bonded to one another, with no space between the two strips. The patent states that other laminations could be provided.

U.S. Pat. No. 2,743,113, Griggs, relates primarily to a metallic running edge for a ski.

U.S. Pat. No. 2,971,766, Holley, shows a wood ski where there are metal edge strips.

U.S. Pat. No. 3,095,207, Head (mentioned earlier herein), shows a ski having a wood core bonded to upper and lower aluminum alloy plates. At the side edges of the ski, there are surface strips 16 made of resin.

U.S. Pat. No. 3,134,604, Aublinger, is another example of a configuration of metal edges that are applied to the lower edge portions of the ski.

U.S. Pat. No. 3,151,873, Riha, relates to a metal ski where there is a top metal section and a lower U-shaped metal section having what might be described as side walls with a corrugated or undulating configuration. The top metal section is a flat plate. The U-shaped metal section has the upper arms or walls of the "U" curved outwardly to join the edge portions of the top plate. Among the various advantages alleged, it is stated that the side walls impart a sufficient flexibility to the ski because the side walls afford relatively small resistance to bending of an edge, with the undulations and the provisions of the edge strips insuring a sufficient resiliency and shock absorption.

U.S. Pat. No. 3,208,761, Sullivan et al, shows a ski having upper and lower metal parts. The lower part has two upstanding side walls and these are made with grooves which match with mating grooves in the top wall. The patent also states that the upper and lower pieces could be reversed, so that the juncture would be at lower edge. The interior of this structure is filled with a foam.

U.S. Pat. No. 3,272,522, Kennedy, shows a composite metal and plastic ski. Specifically, in FIG. 7, there is shown a metal U-shaped member which has an upper flat portion and two depending side flanges. Joining the lower portions of the side flanges is a bracing bar which is welded to the flanges to prevent the flanges from spreading under extreme conditions of stress. There is a foam core which is stated to have a density in the range of 4–30 lbs. per cubic foot.

U.S. Pat. No. 3,352,566, and also U.S. Pat. No. 3,416,810, both of which are issued to Kennedy, show arrangements generally similar to that of the first mentioned Kennedy patent noted above.

U.S. Pat. No. 3,498,628, Sullivan, shows a ski where a U-shaped member is formed in a die, heat treated if necessary, and trimmed. A sheet member is attached to the U-shaped member to form a closed rectangular box section with the interior of the same being filled with a foamed plastic material using foamed-in-situ procedures.

U.S. Pat. No. 3,762,734, Vogel, discloses a metal/-polymer ski construction. The design includes a pair of generally U-shaped metal channel members disposed in opposed relationship to define a cavity. The channel members are joined along the side walls, and the cavity receives a foamed polymer. The edges of the downwardly depending side walls of the top channel member are flared somewhat and provide edge runners for the ski.

U.S. Pat. No. 3,790,184, Bandrowski, discloses a ski construction where the top and sides of the ski are formed as a metal casing to which is attached generally L-shaped running edges. A pair of polymeric sheets is disclosed between the edges spanning the recess formed by the L-shaped running edges.

U.S. Pat. No. 3,360,277, Salvo, disclosed a ski where there is an inverted U-shaped member with downwardly depending side walls flared outwardly at the lower edges. There is a bottom closure plate joined along the edges as a closure member to provide a generally laterally extending peripheral lip. There is an internal stiffener spanning the transverse dimension between the top face of the U-shaped channel and the lower closure plate.

Also, it is believed that it has been suggested in the prior art to place a steel sheet at the lower surface of the ski and join the steel edges to this sheet. It is believed this is primarily utilized as a means of joining the edge members to the ski. (See, for example, U.S. Pat. No. 2,851,277, Homberg et al.)

While there have been attempts since as far back as approximately sixty years ago (as evidenced by the filing date of May 19, 1924 of the Hunt patent, U.S. Pat. No. 1,552,990) to incorporate metal load bearing structure into the design of a ski, to the best knowledge of the applicant, except for the use of upper and lower aluminum alloy sheets in a sandwich-type construction (as shown in the Head patent, U.S. Pat. No. 3,095,207, and as described previously herein), these various other proposed designs using load carrying metal structure have had at most very limited acceptance (if any acceptance at all) in the ski industry. One can easily speculate, with good justification, that the earlier designs incorporating metal structure were either flawed or impractical, or possibly produced a ski having inadequate performance characteristics. It can further be surmized that as the design and manufacture of skis became more sophisticated over the last several decades, the previously ineffective proposed metal structures appeared to fare only worse by comparison.

Further, the trend in ski design was to obtain improved performance without the addition of weight to the ski, or possibly even a reduction in weight. It was only natural to turn to aluminum, the desirable strength to weight characteristics of which were well proven in the aircraft industry, and later to explore extensively the possibilities of fiber reinforced plastic, which has a yield strength to weight ratio substantially greater (i.e. as much as 30% greater) than metals which might be considered, such as aluminum or steel. Further, as indicated previously, the main design parameters (as mentioned previously, flexural stiffness, torsional stiffness, weight and strength) became channeled into relatively narrow ranges which had been proven to be acceptable to the end user. It is believed that the overall trend of this evolution of ski designs has had the effect, as it often does with many technologies, of channeling or narrowing the design efforts along certain known avenues.

Another factor which has affected the evolution of ski designs and manufacturing methods is that much of the valuable information affecting the ski design is highly proprietary to the various ski manufacturers. Much of the data concerning desired performance characteristics and design parameters to achieve such characteristics is derived by empirical methods. Further, as a practical matter, the ultimate test of the quality or excellence of a ski, in terms of consumer acceptance, depends upon its actual performance in various snow conditions, with regard to such things as the stability of the ski in straight downhill travel, how effectively the ski engages the snow in a turning maneuver so as to execute the turn with the least amount of lateral slippage and within an adequately small turning radius, etc. Certainly, the evaluation of physical characteristics of the ski which can be quantified (e.g. flexural and torsional stiffness, weight and strength), as well as the design of the ski relative to these and other characteristics, remains something of an art. Thus, while there has been some published material on ski designs, there are not in the published literature widely accepted and well defined guidelines dictating the specifics of ski design with any great precision. Rather, there are pockets of closely guarded expertise in the refinements of ski design which have been withheld from becoming part of the prior art relating to ski design.

SUMMARY OF THE INVENTION

The ski of the present invention is particularly adapted for effective travel over a snow surface. It is characterized in that it has a high torsional stiffness relative to flexural stiffness, thus enhancing the capability of the ski to turn effectively. Further, the ski also has a quite desirable weight distribution, so that the stability of the ski in straight downhill travel is enhanced.

The ski has a longitudinal axis extending along a lengthwise dimension of the ski, a horizontal width axis and a vertical thickness axis. The ski has an outer structure made of high strength steel. In the preferred configuration, there is an upper steel sheet, a lower steel sheet, and two steel side sheets, with at least one of the upper and lower edge portions of said side sheets being connected to related edge portions of one of the upper and lower sheets.

In the further preferred embodiment, the two side sheets are fixedly connected to the upper sheet, and preferably made integrally therewith. In another configuration, there are only the upper and lower steel sheets, without the two side sheets. In yet another configuration, the two steel side sheets are fixedly connected by their upper and lower edge portions to both the upper steel sheet and the lower steel sheet to make a relatively rigid box structure.

The ski further comprises a core structure positioned between the upper and lower sheets and having substantially planar upper and lower contact surfaces which extend along and are bonded to the upper and lower sheets, respectively, along substantial bonded surface areas thereof. Further, there is a running surface member at a lower surface of the lower steel sheet. A pair of edge members are rigidly connected to opposite lower edge portions of the steel structure.

The ski has a stiffness coefficient between about 15 to 30 pounds per square inch. Further, each of the upper, lower and side sheets has a predetermined thickness and modulus of elasticity.

The ski has a vertical thickness dimension parallel to the vertical thickness axis which is at a maximum in the middle portion of the ski, and diminshes toward forward and rear end surface contact portions of the ski. The ski is characterised in that increase and decrease of the thickness of the upper and lower and sheets are functionally related to increase and decrease in flexural stiffness, respectively. Further, an increase and decrease in the vertical thickness dimension of the ski are functionally related to increase and decrease in flexural stiffness, respectively. The ski is further characterized in that the vertical thickness of the upper and lower sheet and the vertical thickness dimension of the ski along the longitudinal axis are sized and related to one another so that the ski has a distribution of flexural stiffness along its length which follows, with reference to the graph of FIG. 18, a flexural stiffness distribution pattern within about plus or minus one-quarter (desirably plus or minus one-tenth) of a flexural stiffness distribution line of the graph.

In the preferred form, the ski has, relative to its length dimension, a maximum flexural stiffness at the middle portion of the ski which is, with reference to the graph of FIG. 17, relative to stiffness coefficient of the ski, within one-quarter (desirably within one-tenth) of a maximum flexural stiffness value shown in the shaded areas of FIG. 17 for a half-length dimension of ski.

The ski has a vertical thickness dimension at the middle portion which is, with reference to the graph of FIG. 12, within about 12% (desirably within about 5%) of values included in the shaded area of the graph of FIG. 12 representing values of thickness of the ski, relative to flexural stiffness and relative to thickness dimension of the upper and lower sheets.

Within the broader scope of the present invention, where the ski is a relatively short ski, the vertical thickness dimension of the ski at the middle portion is, with reference to the graph of FIG. 12, greater than about 12% in values included in the shaded area of the graph of FIG. 12. Also, for a relatively short ski, this 12% limitation of vertical thickness, relative to the graph of FIG. 12, can be greater where there is longitudinally extending gap means in at least one of the upper and lower sheets.

With the upper sheet having a substantially uniform vertical thickness, the preferred vertical thickness dimension is within about 25% (desirably within about 10%) of a thickness range of between about 0.020 and 0.015 inch. With regard to the lower sheet, the vertical thickness dimension is within 25% (desirably within 10%) of a thickness range of between about 0.015 and 0.010 inch.

The upper and lower sheets are made of high strength steel which preferably should have a yield strength of at least as great as about $200\times10^3$ lb/inch$^2$, and more desirably at least approximately $250\times10^3$ lb/inch$^2$. In the preferred form, the core structure is made from wood capable of withstanding the sheer forces exerted in the core.

In a preferred configuration, each of the side members comprises in cross-section a main body portion having a lower first surface, a laterally and outwardly facing second surface, and a laterally and inwardly facing third surface. The first and second surfaces form an outer lower edge of the edge member, and the third surface abuts related edge portions of the lower steel sheet and the running surface member.

There is a first flange fixedly connected to, and extending inwardly from, an upper inner edge portion of the main body portion. This first flange has a lower surface which is positioned above and bonded to a related upwardly facing edge surface portion of the lower sheet. Also, in the preferred configuration, the edge member comprises a second flange, fixedly connected to and extending upwardly from an upper outer edge portion of the main body portion. This second flange has an inwardly facing lateral surface engaging a lower, outwardly facing lateral surface portion of a related one of the side sheets.

With the configuration of the edge members as recited above, the lower edge portions of the core structure are desirably formed with recesses to receive the first flanges of the two edge members.

In the preferred method of the present invention, there is first provided a fixture having a support surface and two longitudinally extending, laterally spaced rails which provide respective laterally and inwardly facing locating surfaces upstanding from the support surface. The support surface and the locating surfaces define a receiving area.

A lower sheet portion having a plan form configuration corresponding to the ski is placed in the receiving area, and two edge members are placed along side edge portions of the lower sheet portion. This is done in a manner that each of the edge members has an outer contact surface that engages a respective locating surface, with the edge members also engaging the side portions of the lower sheet portion. The sheet portion and the edge portions are thus properly located in the receiving area. Further, each of the edge members has a generally laterally facing aligning surface.

Next, there is provided an upper preassembly portion comprising an upper sheet member and a core member. This preassembly portion is placed onto the lower sheet portion, with the aligning surfaces of the two edge members engaging the upper preassembly portion so as to align the upper preassembly portion with the lower sheet portion and the edge members to form a preassembled ski structure. This preassembled ski structure is bonded in a desired configuration to form the ski.

In the preferred form, the aligning surfaces of the edge members are inwardly facing, and these aligning surfaces engage respective outwardly facing aligning surfaces of the upper preassembly portion. The upper sheet member has two downwardly extending side portions, each of which provides a respective one of the outwardly facing alignment surfaces.

In the preferred form, each of the edge members is formed with an upstanding flange which provides a respective one of the inwardly facing aligning surfaces of the edge members. In another configuration, the core member provides the alignment surfaces of the upper assembly portion, with the aligning surfaces of the edge members engaging the aligning surfaces of the core member in the preassembled ski structure. Specifically, each of the edge members has a laterally and inwardly extending flange, and the aligning surfaces of the edge members are provided on the flanges, with the flanges engaging the aligning surfaces of the core in the preassembled ski structure. The laterally and inwardly extending flanges of the edge members are bonded to upwardly facing edge surface portions of the lower sheet portion.

In the preferred configuration, the lower sheet portion comprises a high strength, lower structural sheet and a lower running surface member positioned below the structural sheet. The running surface member is bonded to the lower structural sheet in the ski. In the preferred method, the lower structural sheet and the running surface member are prebonded to one another to form a prebonded lower sheet portion prior to placing the lower sheet portion in the receiving area.

With regard to the configuration of one of the alternate embodiments of the present invention, where the two steel side sheets are fixedly connected to both the upper and lower sheets, the edge members are in this particular embodiment configured as follows. There is a first laterally extending leg portion which extends below and outwardly beyond an outer surface of the lower edge portion of an adjacent one of the side sheets. There is a second upwardly extending leg portion positioned within an inside surface of the lower edge portion of that side sheet, and also positioned adjacent an edge portion of the lower sheet. Each of the lower edge portions of the side sheet is laser welded to its adjacent edge member at spaced locations along the longitudinal axis of the ski. Also, each edge portion of the lower sheet is laser welded to its related edge member at spaced locations. Other configurations of the edge members are described in the application, and these will become apparent from an examination of such descriptions.

Further, in accordance with another embodiment of the method of the present invention, there is first provided a first steel blank which has edge portions thereof formed as downwardly extending side members and also a lower steel sheet or section, as described previously. A core member is bonded to the lower surface of the first steel section, and the lower steel section is bonded to the lower surface of the core member.

Then lower edge portions of the side members, lateral edge portions of the second lower steel section, and steel edge members are interconnected by means of laser welding. This is done in a manner to localize heating of the edge portions and the edge members so that these can maintain their predetermined strength characteristics in the ski made by this method. The manner of attachment, as well as the configuration of the edge members can be accomplished in various ways, as described in more detail in the application.

Other features of the present invention will become apparent from the following detailed description.

BRIEF DESCRIPTION OF THE DRAWINGS

FIG. 14 is a graph plotting yield strength versus flexural stiffness, again comparing the same skis as in FIG. 12;

FIG. 15 is a graph plotting torsional stiffness against flexural stiffness, and again comparing the three skis compared in FIG. 12;

DESCRIPTION OF THE PREFERRED EMBODIMENTS

A. General Considerations

The alpine snow ski of the present invention is structured principally of thin metallic sheet. The preferred embodiment is the first of its kind to provide the dual advantages of improved skiing performance and a method of manufacturing that is largely free of manual labor. The preferred embodiment consists mainly of an upper inverted U-shaped channel of thin, high strength steel, nested with a close-fitting core of wood. The steel edge is specially configured in such a way that it serves to "lock" the core and steel upper part in position with respect to a lower prelaminate of thin steel and plastic. The advantage of this embodiment to the manufacturer is that the assembly requires very few parts, and each of the parts can be produced by automated, computer controlled, high-speed equipment. The advantage of this embodiment to the skier is a vast improvement in performance over skis that are presently available. The improved performance is mainly a consequence of the steel sheet structure. Steel has a very high modulus of rigidity (stiffness in shear) and high density, compared to aluminum or fiber-reinforced composites that are widely used in current ski production. The applicant has discovered that in optimizing the design of the ski, the rigidity property endows the ski with high torsional stiffness so that a low flexural stiffness can be designed into the ski with no sacrifice in edge holding ability. The applicant has the steel introduces a unique distribution in the weight of the ski, which has the unexpected advantage of creating an easy-turning ski that is highly stable in fast running.

To the best knowledge of the applicant, the design and fabrication method shown here has never before been disclosed. The design and fabrication method is useful to both the consumer and the manufacturer. As such, the design and fabrication method shown here solves a long-standing problem that many skilled ski engineers have studied. That is the problem of finding a new ski design that has both skiing performance advantages and manufacturing cost advantages over ski designs currently in widespread use.

Figure 1:
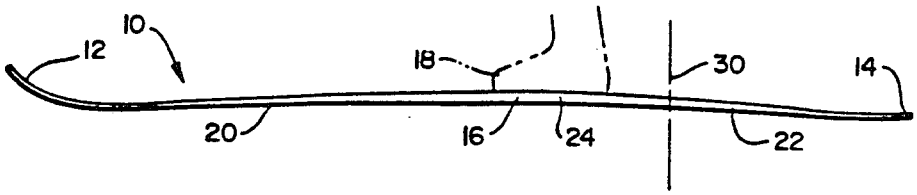
FIG. 1 is a side elevational view of the ski made in accordance with the present invention.
Figure 2:
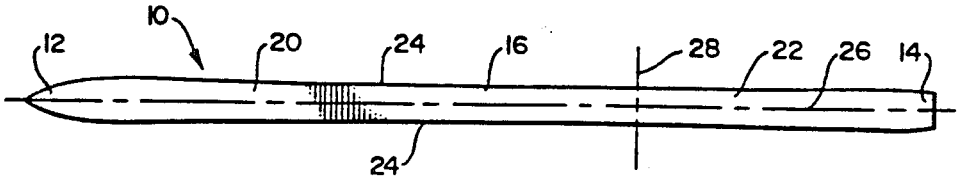
FIG. 2 is a top plan view of the ski of FIG. 1.
Figure 3:
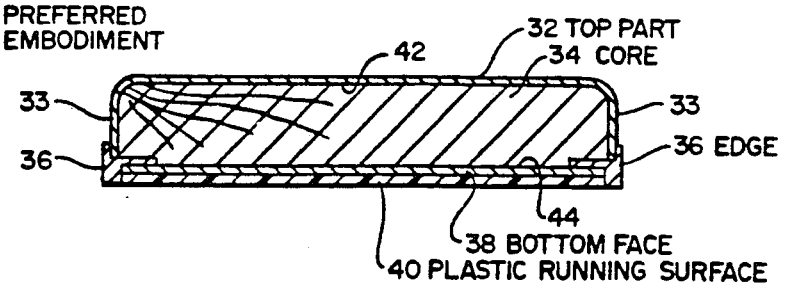
FIG. 3 is a transverse sectional view illustrating the cross-section of the ski of a first embodiment of the present invention.

With reference to FIGS. 1–3, there is shown a snow ski 10 made in accordance with the present invention. This ski 10 has a front end, which has an upturned tip portion 12, a moderately upturned rear end 14, a middle portion 16 upon which the person's foot rests (a person's ski boot being indicated in broken lines at 18), a forward transitional portion 20 (extending between the tip portion 12 and the middle portion 16) and a rear transition portion 22 (extending from the rear end 14 to the middle portion 16). The ski has two side surfaces 24, and each of these curve moderately inwardly in a generally concave curve toward the middle portion 16. Thus, the forward and rear ends 12 and 14 of the ski 10 are moderately wider than the width at the middle portion 16. As is well known in the design of skis, this particular configuration gives the ski its inherent turning capability.

For purposes of description, the ski 10 can be considered as having a longitudinal axis 26 parallel to the length of the ski 10, a horizontal width axis 28 and a vertical thickness axis 30, with the length, width and thickness dimensions being measured along these axes, respectively.

B. General Description of the Ski of the First Embodiment

FIG. 3 shows a cross-sectional view of the first embodiment, which is the preferred embodiment. This shows a substantially flat or planar steel top part 32 with attached side walls 33, laminated to a wood core 34, steel edges 36, a flat steel bottom face 38 and a plastic running surface 40. The top part 32 consists of a single piece of stainless steel, with a coating of rubber 42 in the core side. The core 34 is a laminate of any high grade wood or foam suitable for laminated alpine skis. Each of the edges 36 is a special shape of high carbon steel designed to facilitate the fabrication process. The bottom face 38 is also high-carbon steel; it has a coating of rubber 44 on the core side, and the plastic layer 40 is prelaminated to the bottom side. The core extensions at the tip 12 and tail 14 are plastic layers which form the core in the tip and tail regions beyond the running surface.

The inventor has produced prototype skis similar in likeness to the one shown in FIGS. 1–3 and finds that these skis have a variety of very distinctive properties. First, steel skis of this type have a very high torsional stiffness for any given flexural stiffness, when compared to skis of high quality that are currently available. This means that extremely good edge holding quality is achieved with a very low flexural stiffness with this design. Generally, a low flexural stiffness contributes to creating a ski which turns with little effort, a property that is desired by all skiers. Second, for equal weight the steel ski has more weight distributed toward the extreme ends of the ski. This means that better stability in fast running is obtained with this design, with no added total weight, compared to available high quality skis. Third, this design has a distinctive appearance; the smooth top edge corners, low thickness profile and shiny surface of exposed stainless steel provide striking visual features that are common to no other ski. In fact, the steel top and sides provide the manufacturer with a host of new options for cosmetic application and design that are not possible within the context of conventional aluminum or fiberglass structured skis.

The high torsional stiffness, low flexural stiffness, unique weight distribution and distinctive visual appearance add up to provide a highly marketable set of features that are tangible and meaningful to all skiers. Furthermore it is obvious to those skilled in ski design that skis of this steel construction can be profiled in such a way that models tailored to skiers of all abilities, from beginners to racers, can be produced with excellent success.

C. Description of the Manufacturing Method of the First Preferred Embodiment

The foregoing ski construction is designed for optimum manufacturing, in the sense of minimizing labor and material costs. This is accomplished by balancing the cost of each material against the cost of labor required for producing each part, in such a way that the total labor needed for manufacturing is minimized. The main idea is to limit the parts fabrication function to operations that can be automated; even if more material expense is incurred in doing so. The optimization is accomplished as follows.

The top part 32 and side walls 33 are produced by first laser cutting a blank part from coils of stainless steel that have been heat treated and then rubber coated on one side. The blanks are then magazine fed into a specially designed roll forming machine that rolls the side walls 33 downward. The bottom face 38 is likewise laser cut from coils of carbon steel that have been rubber coated on one side, and fused or otherwise laminated to the plastic running surface 40 on the other side, after having been silkscreen decorated on the bottom side. The core 34, edges 36 and core extension parts are all produced according to standard modern ski-making procedures.

All (or most) of the foregoing parts fabrication operations are most profitably performed by suppliers who specialize in the respective tasks. Each of the functions is machine-automatic; this means that the dominant cost of each part is always the material, and never labor, overhead or indirect material.

If each of the parts are produced by suppliers exterior to the ski factory, the in-house tasks are limited to assembly, top decoration and edge grinding. The labor needed for the decoration and grinding functions is limited largely to that of transferring skis from one automated work station to another (unskilled labor). This leaves the only significant hand labor task in the assembly operation. This operation is streamlined by introducing the concept of "fixtureless laminating". In this method of assembly, a preassembly of the ski is formed by attaching all parts of the laminate together in such a way that the preassembled ski can be placed into the ski press without the need for a fixture to hold the parts in position relative to one another. This produces a significant labor savings in the laminating operation, because there is no laminating fixture to be cleaned of the epoxy squeeze-out. The fixtureless laminating method is a crucial facet of the preferred method of the present invention.

Figure 4:
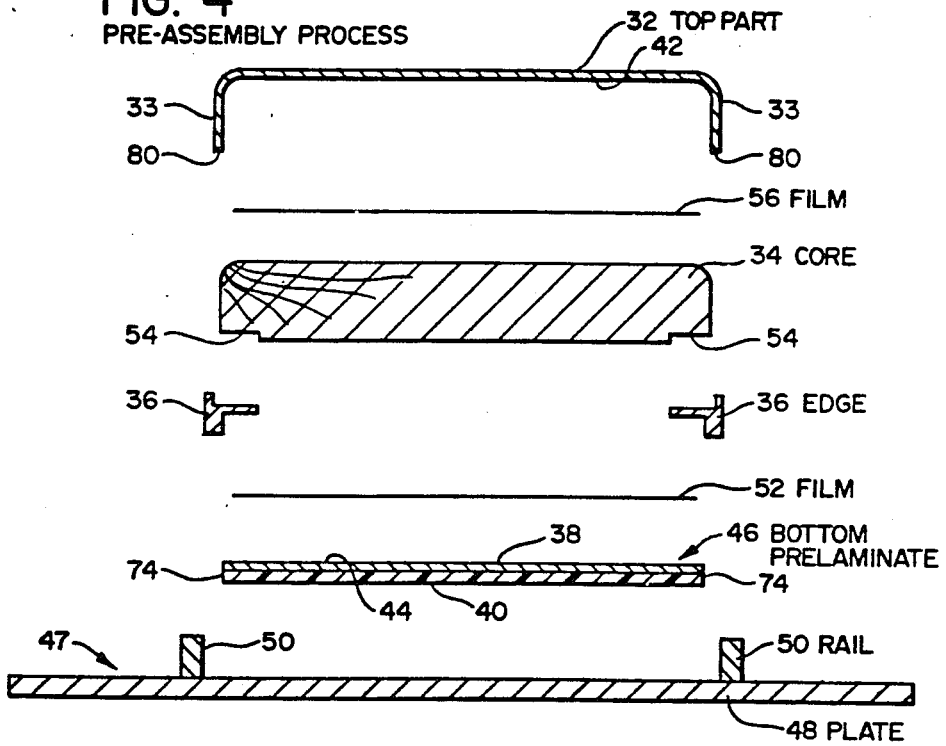
FIG. 4 is a sectional view of the components of the ski of the present invention as part of the preassembly in the process of the preferred embodiment.

The only fixture required is the one used in the preassembly operation, which is a "dry" operation so that the cleanup of a "wet" epoxy system is never needed. The preassembly operation consists of the following seven steps and is illustrated by way of a blown up sectional view shown in FIG. 4.

1. The bottom, prelaminated part 46 (comprising the bottom face 38 and the plastic running surface 40) is placed into a simple fixture 47 consisting of a thin bottom plate 48 with side rails 50 fixedly connected to the plate 48 and defining the contour of the ski.
2. A layer of epoxy film adhesive 52 is laid on the bottom prelaminate 46.
3. The edges 36 are laid in place.
4. The core 34 has a bead of adhesive such as cyanoacrylate (CA) adhesive (super-glue) applied to each of two edge notches 54, and is placed into the fixture. The core extensions are also put in place at the tip and tail portions of the preassembly, with the CA adhesive being used to bond them to the steel edge. These core extensions can be pieces of plastic of the desired configuration. The cure time for the CA adhesive to bond these components is about 60 seconds.
5. A layer of epoxy film adhesive 56 is laid on top of the core 34.
6. The top part 32 is laid in position shown in FIG. 3, and the laminate is pressed together by hand. The "tack" of the film adhesive 52 and 56 and the CA adhesive together provide the means for holding the parts in their proper positions.
7. The preassembly is removed from the fixture and either stored or placed directly into a standard ski laminating press and cured without any fixture. The ski press gives the ski its final camber profile and can be a standard prior art ski press which presses the components together and applies heat for a predetermined period of time, after which the assembly is cooled to form the finished ski.

The matter of fixtureless laminating deserves special emphasis because it is an important means by which economy is achieved in this manufacturing process. The prior art fixture is eliminated by the carefully-designed construction, and by use of the epoxy film and CA adhesives. The film adhesives 52 and 56 are more expensive than wet epoxy systems, but the added cost is more than offset by a large savings in manual labor. This savings is realized by obviating the fixture cleanup and fixture preparation functions necessary in the prior art operation and by eliminating the cleanup of the assembled ski that is always required when wet epoxy systems are utilized. Note that usage of the film adhesives 52 and 56 is minimized in this process because the plastic running surface 40 and rubber layers 42 and 44 are bonded to the steel prior to the laminating step. Accordingly, only two bond lines must be made during the laminating step.

The inventor has conducted an extensive cost evaluation program for skis produced by the foregoing design. One can estimate the factory door cost at $35–$40 (1986 dollars) per pair based on accurate quotations for material costs and conservative estimates for the cost of parts production by suppliers exterior to the assembly factory. The factory door price does not include any marketing burden or factory overhead. As a comparison, one can estimate that the equivalent cost for production of quality skis in America to be $46 per pair. The savings of about 20% is primarily a consequence of automation in the process.

The concept of the assembly plant manufacturing facility is appealing because the in-house direct labor cost is a small part of the total manufacturing cost. This is because very few operations need to be performed to produce the final product once all the parts are received in the factory. Once can estimate the in-house labor cost to be less than 10% of the total ski cost. This lowers the pressure to locate manufacturing in low labor rate areas. It enables assembly site selection to be based on other factors such as shipping convenience, proximity to major markets or availability of experienced supervisory personnel.

Another advantageous feature of the present invention is that the particular configuration of each of the steel edges 36 is such that it not only satisfies the structural requirements of the ski of the present invention, but also cooperates with the other components that make up the ski to contribute to the self-aligning feature that simplifies the preassembly of the components. More specifically, with reference to FIG. 5, each edge member 36 comprises in cross-section a main body portion 58 that has a generally rectangular configuration. This main body portion 58 has an outer side surface 60 and a bottom surface 62 which meet to form the right angle edge 64.

The edge member 36 further comprises a flange 66 which extends inwardly and laterally from an upper inner edge of the main body portion 58 and fits into a related right angle edge notch 54 formed in the lower edge of the core 34. The edge member 36 also comprises an upstanding flange 68 extending upwardly from and upper outer edge of the main edge portion 58. The lateral outside surface of the flange 68 is co-planar with the laterally outward surface 60 of the main edge portion 50. The inwardly facing surface 70 of the upstanding flange 68 fits against the lower portion of the outside surface of the related side wall 33. The inwardly facing surface 72 of the main body portion 58 fits against the lateral edge surface 74 of the prelaminate 46.

Thus, it can be appreciated that in forming the preassembly (shown in FIG. 4), the edges 36, being positioned adjacent to the rails 50 of the fixture 47, properly locate the prelaminate 46 by engagement of the edge inner surfaces 72 with the outer edge surfaces of the prelaminate 46. Further, the inwardly facing surface 70 of the upstanding flanges 68 of the edges 36 properly locate both the top part or face 32 with its integral edges 33, and also the core 34.

With regard to structural considerations, the upper surface 76 of the lateral flange 66 of the edge 36 is bonded (i.e. by the previously described application of adhesive) to a downwardly facing surface of the notch 54 formed in the core 34. The bottom surface 78 of the flange 66 is (by the action of the edge portion of the adhesive film 52) bonded to the upper surface of the prelaminate 46 (i.e. to the bottom steel sheet or face 38).

Also, the top part 32 and the side walls 33 are dimensioned, relative to the core 34 and the edges 36, so that the lower edge 80 of each side wall 33 is spaced a short distance upwardly (e.g. 0.005 inch) from the upwardly facing surface 82 of the edge 36 just inwardly of the lateral surface 70. This is to provide adequate clearance so that the lower edge 80 would not bear against the surface 82 so as to possibly obstruct suitable bonding engagement of the top part 32 with the core 34.

Figure 5:
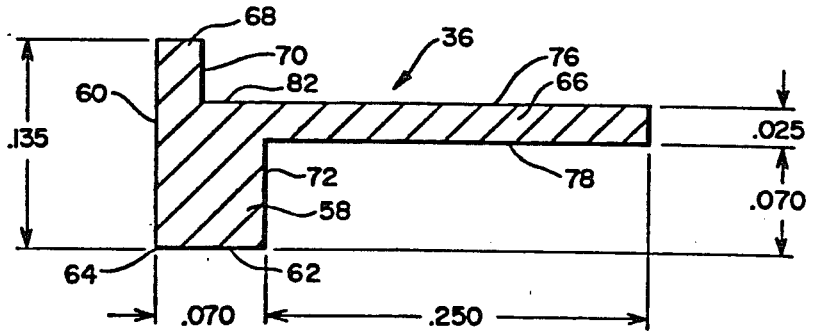
FIG. 5 is a transverse sectional view, drawn to an enlarged scale, illustrating one of the edge components of the present invention.
Figure 5A:
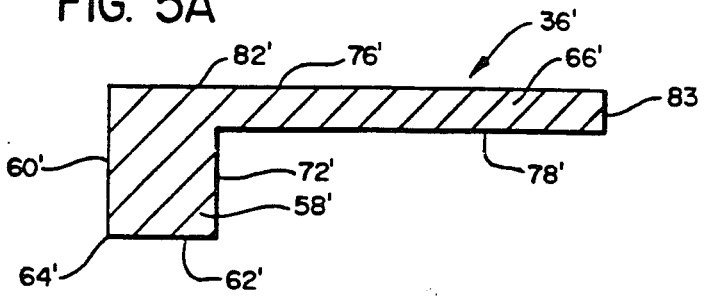
FIG. 5A is a view similar to FIG. 5, showing a modified form of the edge member.

A modified version of the edge member 36 is illustrated in FIG. 5A and generally designated 36'. This edge member is substantially the same as the first described edge member 36, except that the upstanding flange 68 is eliminated. Because of the similarity of the modified version 36' to the first version 36, there will be no detailed description of this modified version shown in FIG. 5A. Rather corresponding components will be given like numerical designations, with a prime (') designation distinguishing those of the modified version.

The locating function of the modified edge member 36' is accomplished by means of the inner surface 83 of the laterally and inwardly extending flange 66' engaging the lateral surface of the notch 54 of the core 34. The top part 32 is aligned by virtue of the engagement of the sidewalls 33 with the side surfaces of the core 34. In other respects, this modified edge member 36' functions in substantially the same manner as the first described edge member 36.

D. Details of the Design

Several details that are important to the design of the preferred embodiment are discussed in this section.

1. The Top 32. There are three critical facets of the top design. They are the yield strength, the elongation at yield and thickness of the material. For most skis, the minimum yield strength of 250,000 psi is required in the top face in order to insure against unwanted permanent bending of the ski under conditions of severe usage, such as skiing over very bumpy terrain. At the same time a minimum elongation at yield of about two percent is needed in order to enable the unfractured bending of the downward facing legs or side walls 33 of the U-shaped channel formed by the top part 32 and the side walls 33, without an excessively large bend radius. The thickness of the steel sheet forming the part 32 and the side walls 33 must be chosen to be thick enough to minimize the maximum strain in the top face 32, but thin enough to minimize the weight of the ski. A thickness of from about 0.015 inches to 0.020 inches is found to be optimum for most alpine ski types.

An example of a material that satisfies the foregoing criteria is stainless 17-7 condition CH900 (Republic Steel Corp. designation).

Notice that the preferred embodiment has a coating of rubber 42 on the core side of the top face 32. The purpose of the coating is two fold. The rubber serves to decrease the susceptibility of the core to top bond line to fracture. It also tends to introduce a damping effect into the vibrational character of the ski. The thickness of 0.010 inch for the rubber coating is optimum for bond line strength enhancement.

2. The Core 34. There are three critical facets to the selection of core material: compressive strength, tensile strength, and shear strength. A compressive strength of about 5000 psi is required to prevent any tendency of the thin top face 32 to buckle near high strees points, such as the binding area. A tensile strength of about 400 psi is needed to insure sufficient binding screw retention strength. A shear strength of about 1000 psi is required to withstand the shear load in the core that is generated in bending of the ski. Typically, the strength properties of high quality wood laminates are more than adequate for use in the preferred embodiment. For example, a three part laminate of red oak was used in prototype test skis.

3. The edge 36. It is well known that a yield strength of about 250,000 psi is needed in the steel edge in order to avoid permanent bending of conventional skis. The same is true for the preferred embodiment of this invention. The shape of the edge 36 and strength requirement are such that the edge is most advantageously produced out of high carbon steel using well known rolling and subsequent heat treating techniques. Typically a carbon content of from seven percent to nine percent is adequate for ski purposes.

Details of the edge configuration of the preferred embodiment are given in FIG. 5. Note that, to the knowledge of the inventor, this edge configuration is unique. It is this type of edge configuration that enables lamination of the ski without a fixture. Therefore this edge shape is a crucial facet of the invention.

4. The Bottom Face 38. The bottom face material must satisfy the strength requirements of the top part 32 and edges 36. Since no small radius bends need to be made in the bottom face, there is no restriction on the elongation. Therefore, one can use for example the same (or similar) tempered, high carbon steel for the bottom face 38 that is used in the edge 36.

The rubber coating is applied to the core side of the bottom face or sheet 38 for the same reasons it is applied to the core side of the top face.

The thickness of the bottom steel face is selected by optimizing the competing effects of weight in the structure and strain on the bottom face. A thickness of from 0.010 inches to 0.015 inches is found to provide good qualitites in most skis.

5. Adhesives. The epoxy film adhesive 52 and 56 is selected for two reasons. The first is that, to the best knowledge of the inventor, only epoxy will provide an adequate bond to rubber. The second is that a film adhesive can be used without experiencing squeeze-out of excessive adhesive during the laminating step. Squeeze-out poses a cleanup problem to both the ski and the laminating press. Obviating squeeze-out removes a significant portion of the manual labor in ski assembly.

The cyanoacrylate (CA) adhesive used to effect the preassembly is selected for its fast cure time. Strength is not a significant concern for this purpose, whereas speed of assembly is of considerable concern.

6. Other Considerations. It is clear that once the criteria controlling selection of materials for the various components of the preferred embodiment are understood, a variety of alternative selections could be made. For example, the 200,000 psi yield, low carbon steel sold under the trade name "MartINsite" (Inland Steel Corp.) could be substituted for the stainless steel in the top face 32, for skis intended for non-severe service such as skis for a small child. With regard to the core 34, one can expect that adequate strength properties could be obtained with a core of high pressure injected polyurethane or epoxy based foam. The presence and/or thickness of the rubber coating is not crucial to the performance of the ski. It is well-known that by varying the amount of rubber used in the ski, the vibrational character can be substantially altered. Also, additional savings could be obtained if a method were to be devised to easily clean up the squeeze-out when a wet epoxy adhesive is used, or to minimize the squeeze-out by some special application techniques. Other design criteria relating to the overall design of the ski are discussed later herein.

E. Description of the Second Embodiment

Figure 6:
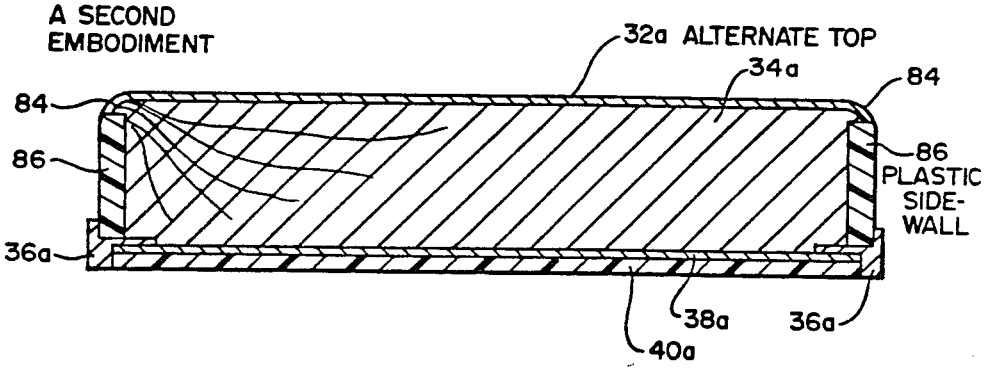
FIG. 6 is a transverse cross-sectional view similar to FIG. 3, showing a second embodiment of the present invention.
Figure 7:
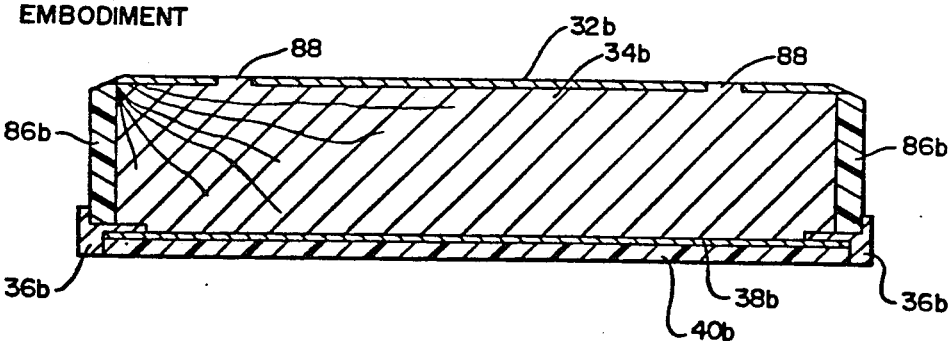
FIG. 7 is a transverse sectional view, similar to FIGS. 3 and 6, showing yet a third embodiment of the present invention.

The second embodiment of the present invention is shown in FIG. 6. Components of this second embodiment which are the same or substantially similar to components of the first embodiment, will be given corresponding numerical designations, with an "a" suffix distinguishing those of the second embodiment.

Thus, as shown in FIG. 6, there is a top part or face **32*a*, a core 34*a*, two steel edges 36*a*, a bottom part or face 38*a* and a plastic running surface 40*a*. The second embodiment differs from the first embodiment in that instead of having side walls 33 that are made integral with the top part 32 (as in the first embodiment), the lateral portions of the top part 32*a* are formed as down turned edge portions 84, extending downwardly only a very short distance. In place of the two side walls 33, there are two plastic side walls or layers 86**.

The manufacturing process for the second embodiment is substantially the same as that described with reference to the first embodiment. The two plastic side walls 86 can be prebonded to the side surfaces of the core **34*a* or bonded to the core 34*a* at the time of assembly in the fixture 47**.

This second embodiment of FIG. 6 is somewhat less desirable than the first embodiment in that it will inherently have lower torsional stiffness than the first preferred embodiment. However, this second embodiment could be used for special or limited service application.

F. Description of the Third Embodiment

This third embodiment of the present invention is presented to illustrate that the method of the present invention could be practiced without making the top and bottom parts (illustrated at 32 and 38, respectively, in the first embodiment) out of steel having the characteristics specified previously herein. While such a ski would lack certain desired characteristics of the ski of the first embodiment, the benefits resulting from the method of the present invention would be realized.

Components of this third embodiment will be given numerical designations that are used for corresponding components of the first and second embodiments, except that a "b" suffix will distinguish the components of this third embodiment.

Thus, there is a top part of face **32*b*, a core 34*b*, edges 36*b*, a bottom face or part 38*b* and a plastic running surface 40*b*. The top part of face 32*b* and the bottom part of face 38*b* could be made of material other than high quality steel (e.g. fiber reinforced plastic) in which case these parts of surfaces 32b and 38b would likely have a greater thickness dimension than the corresponding parts 32 and 38 of the first embodiment. The core 34b, edges 36b and lower running surface 40b could be substantially the same as in the first embodiment. Likewise, two plastic side walls 86b** could be provided as in the second embodiment.

The manufacturing process for this third embodiment is substantially the same as that described with reference to the first embodiment, except that provisions must be made for indexing the top part 32b relative to the core 34b. This can be accomplished, for example, by providing a set of dowels 88 at spaced locations along the length of the top surface of the core 34b, with corresponding holes or recesses being formed in the top part 32b to receive the dowels 88.

This third embodiment is less desirable than either the first and second embodiments. While it does incorporate the benefits of the method of the present invention (low labor cost), the resulting ski would inherently have lower torsional stiffness than the skis of the first two embodiments.

G. Description of the Fourth Embodiments

Figure 8:
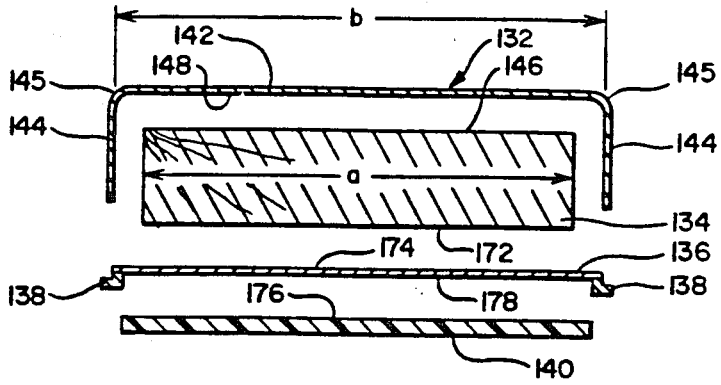
FIG. 8 is a transverse sectional view illustrating the cross-section of a fourth embodiment of the ski of the present invention, with the component parts being separated from one another.
Figure 9:
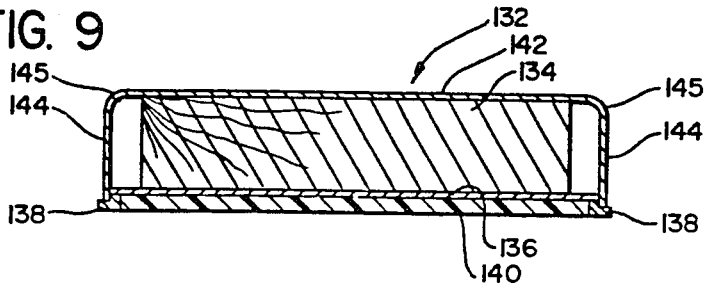
FIG. 9 is a view similar to FIG. 8, but showing the components of the ski in their assembled positions as a finished product.
Figure 10:
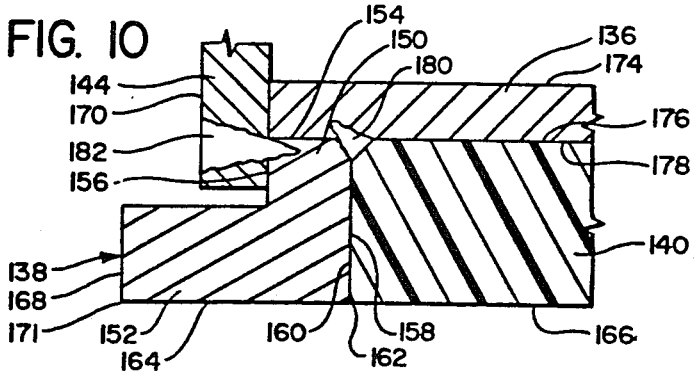
FIG. 10 is a transverse sectional view, drawn to an enlarged scale, showing the left edge portion of the ski as shown in FIG. 9.

With reference to FIGS. 8–10, the ski of the fourth embodiment comprises the following: a top section 132 having a generally inverted U-shaped configuration; a core 134 having a generally rectangular cross-sectional configuration; a lower generally planar sheet 136; two lower edge members 138, shown welded to the sheet 136; and a running surface member 140. The top section 132 is made of high strength steel and comprises an upper sheet 142 and two vertical side sheets 144 formed integral with the sheets 142 and joined thereto at respective curved connecting edge portions 145.

The core 134 has a generally rectangular cross-sectional configuration and has a top planar surface 146 which in the end configuration is bonded to the lower surface 148 of the upper sheet 142. The width dimension of the core 134 (indicated at "a" in FIG. 8) is moderately less then athe width dimension (indicated at "b" in FIG. 8) between the inside surfaces of the side sheet portions 144.

As in the first three embodiments, the core 134 can quite advantageously be formed of wood. The lower sheet 136 is, as in the first two embodiments, made of high strength steel, and it has a width dimension substantially the same as (or very slightly less than) the interior width dimension (indicated at "b" in FIG. 8) of the inside surfaces of the side sheets 144.

In the particular configuration shown herein, each of the edge members 138 has in cross-section an L-shaped configuration, so that there is an inner upstanding leg 150 and a outwardly and laterally extending leg 152. The leg 150 has an upper surface portion 154 which is positioned adjacent an outer lower edge surface portion of the lower sheet 136. The leg 150 also has an outwardly facing surface 156 which bears against a lower inwardly facing surface portion of its related side sheet 144. Further, the leg 150 has an inwardly facing surface 158 which is positioned adjacent a lateral surface 160 of the running surface member 140. The lower inside corner 162 formed by the inside surface 158 and lower surface 164 of the edge member 138 is a relatively sharp right angle corner. This enables the lower surface 164 of the edge member 138 to form with the lower running surface 166 of the running surface member 140 a substantially uninterrupted and continuous planar surface made up of the two lower edge surface portions 164 and the main central surface 166 of the running surface member 140. As in the earlier embodiments, the running surface member 140 is made of plastic.

The laterally extending outward leg 152 of the edge member 138 has an outer laterally facing surface 168 that extends moderately beyond the outer surface 170 of the side sheet 144. This side surface 168 meets the lower edge surface 164 at a right angle edge 171. It can be appreciated that in this particular configuration, the two surfaces 168 and 164 are positioned so that these surfaces 164 and 168 can be filed to maintain the edge 171 adequately sharp for proper performance of the ski.

In the assembled configuration, the core 134 has its upper surface 146 bonded to the lower surface 148 of the upper sheet 142, and its lower surface 172 bonded to the upper surface 174 of the lower sheet 136. The running surface member 140 has its upper surface 176 bonded to the lower surface 178 of the lower sheet 136, and the two side surfaces 160 of the member 140 may be bonded to the inside surfaces 158 of the two edge members 138. A suitable laminating resin is utilized to accomplish this bonding, such as a flexibilized epoxy, one such epoxy being Ren product RP136/H994.

The top section 132, the lower sheet 136 and the two lower edge members 138 are fixedly and rigidly joined to one another to form a unitary box structure, this being accomplished by laser welding. The manner in which this is accomplished will be described specifically hereinafter. In the specific configuration shown herein, the two edge members 138, are welded to the lower sheet 136 at spaced locations at the upper inner edge portion of each edge member 138, such weld locations being indicated at 180. Further, the edge members 138 are each welded to the lower edge portion of the side sheets 144, with these weld locations being indicated at 182.

H. Method of Manufacture of the Fourth Embodiment

The top section 132 and the lower sheet 136 are formed as in the method of the first embodiment. The running surface member 140 is shaped in accordance with methods well known in the prior art. For example, a plurality of such surface members 140 may be placed in stacks and formed in equipment commonly used in both the wood working and ski making industries.

The two edge members 138 and the lower sheet 136 are assembled in a holding jig specifically constructed for each size of the lower sheet 136. Then the two edge members 138 are laser-welded to the sheet 136 by directing the laser beam at an angle of about 45° to the sheet surface 178 and about 45° to the inside surface 158 of the edge member 138. This is accomplished by using a 0.10 second exposure to a 900 watt $CO_2$ pulsed laser beam, focussed at the weld point (i.e. the juncture lime of the surfaces 178 and 158).

The spacing of the weld locations will depend upon a number of factors, such as the strength of each spot weld itself, and the stress which is expected to be placed upon the ski which is the end prouct. It is believed that a spacing of the weld spots of approximately $\frac{1}{4}$ to $\frac{1}{2}$ inch would be satisfactory. In the construction of a prototype which is rather similar in structure to the preferred embodiment described herein, weld spacing of approximately $\frac{1}{2}$ inch was found to be satisfactory.

Then, the top section 132, the core 134, the lower sheet 136 with the two lower edge members 138 welded thereto, and the running surface member 140 are assembled as a laminated assembly, with epoxy adhesive applied to the upper and lower surfaces 146 and 172 of the core 134, and also to the top surface 176 of the running surface member 140. This assembly is placed in a standard ski making press. To assist in keeping the parts in their proper locations with respect to one another, a single wrap of Mylar tape can be applied at the center and extreme ends of the assembly.

In this laminating stage of the process, the final bottom camber curve is established in the ski, as it is for skis made in standard laminated ski making. To insure that the proper camber curve is obtained, which is adjusted by the curve of the ski press itself, it is important that the epoxy bond lines have a uniform pressure on them. This can be guaranteed by allowing a slight clearance (e.g. about 0.005 inch) between the lower surface of each of theside sheets 144 and the upper surface of the leg 152 of the edge member 138. In this way, the side sheet 144 cannot bear any of the ski press loading, and uniform bond line pressure is maintained.

A total cure cycle of about twelve minutes is needed for the laminating process, depending upon the adhesive used. This includes heat up from room temperature up to about 200° F., where the temperature is maintained for about ten minutes, followed by cooling to at least 130° F. prior to removal from the press. This forms the basic structure of the ski with the proper contour.

Following the bonding operation described above, the assembly is finished into the form of the final ski by welding the lower edge portion of each side sheet 144 to the vertical leg portion 150 of its related edge member 138. This is accomplished by using the same laser welding technique discussed above. The spot welds are repeated at approximately one-half inch intervals along the two sides of the side sheets 144. The beam is directed laterally against the lower part of the outside surface 170 of the side sheets 144. This can be accomplished by moving the ski past the stationary laser beam, using an automatic indexing fixture designed to present the proper part of the ski to the laser focal point.

In comparison with other welding techniques, this particular method of spot welding provides a number of rather significant advantages. First, an analysis of the manner in which forces are transmitted through the box structure of the ski indicates that the strength of a continuous weld is not needed. Thus, this process takes advantage of the higher production rate of the spot welding technique, as described above. Second, by utilizing this laser spot welding technique, there is only a very small amount of distortion (which is within acceptable limits) as a result of the localized heating in the weld zone. If such distortion were excessive, this could result in undesired changes in the camber curve of the ski. The third advantage is that the metallurgical properties of the welded materials are affected the least with this specified type of weld.

I. Physical Characteristics of Present Day Prior Art Skis Compared to the Skis of the Present Invention As indicated previously, the evolution of ski designs has been such that in terms of basic structure, there are three types of skis which are commonly used by present day skiers, namely: (a) the ski having upper and lower aluminum sheets formed in a sandwich structure, (b) fiber reinforced plastic used in a sandwich or box structure, and (c) aluminum and fiber reinforced plastic combined in a sandwich structure. With regard to the fiber reinforced plastic ski formed in a box structure, its physical characteristics follow relatively closely the characteristics of the fiber reinforced plastic laminate structure, since the core of the ski, extending out to the side walls of the box structure function with the side walls in generally the same manner as laminations between the top and bottom surfaces of the ski. Further, as indicated previously, these designs have evolved to a point where a very narrow range of ski weight and stiffness is found acceptable to the ski market.

Figure 16:
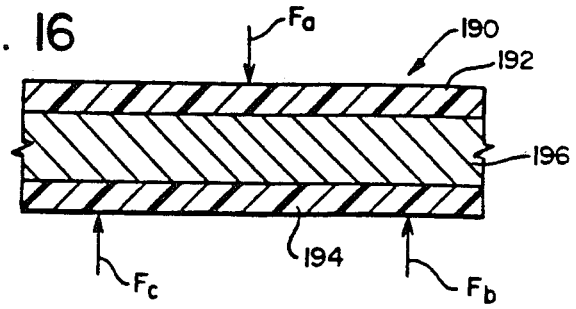
FIG. 16 is a somewhat schematic view of a lengthwise section of a typical fiber reinforced plastic ski, illustrating an application of forces to create a bending moment.

To begin our presentation of the analysis of ski designs, relative to the present invention, let us first simply consider a ski as a beam which is to resist bending movements along the lengthwise axis of the beam. Reference is now made to FIG. 16, which illustrates in a side elevational view a typical section of a fiber reinforced plastic laminated ski. This ski section 190 has a top fiber reinforced plastic lamination 192, a bottom fiber reinforced plastic lamination 194, and a core 196 made of either wood or foam.

If we are to consider the bending moment applied to this ski section along its longitudinal axis, we can assume that there is a first load $F_a$ applied downwardly at the center of this section, and two upwardly applied forces $F_b$ and $F_c$ applied upwardly at the end portions of the section. Fiber reinforced plastic has a very high strength to weigh ratio (particularly in withstanding tension loads). For example, fiber reinforced plastic can have a strength to weight ratio in resisting tensile loads as much as 25–30% higher than relatively high quality steel. Thus, this simple analysis would indicate that this fiber reinforced structure is quite desirable as a structure for a ski since it tolerates high bending moments and yet provides a relatively light structure. Aluminum has somewhat less strength to weight ratio than fiber reinforced plastic relative to tensile loading, but aluminum does have a strength to weight ratio which is sufficiently high to make it attractive also for consideration as a material in laminated ski construction. Thus, it can be appreciated why over the last two decades particularly relatively greater attention has been given to the benefits of fiber reinforced plastic in ski design, and why much of the design efforts in improving skis has been directed toward designs which work within the framework or fabric of the designs relating to fiber reinforced plastic.

However, it has been found in formulating the design of the present invention, such an analysis, in addition to being an oversimplification, turns out to be misleading. It should be emphasized that the further analysis as presented below, which the applicant herein performed to arrive at the basic concept of the present invention and evaluate the same, does not, to the best knowledge of the applicant, exist in this form in the prior art. Thus, while the following analysis is believed to follow a quite logical pattern, it is not to be presented that it is readily available to others having ordinary skill in the art to independently retrace the various steps which led to the present invention. As a prelude to arriving at the basic concept of the present invention, some preliminary analysis was performed by the applicant herein relative to a somewhat idealized model of a cross-section of a ski. This idealized model is shown in the exploded view of FIG. 11. There is a top sheet or plate 200, a bottom sheet or plate 202, two side sheets or plates 204, a rectangular core 206, two steel edge members 208, and a bottom running surface 210. It is presumed that the two edge portions are made of a very high quality steel so that these would be able to maintain the sharp edge over a long period of time. (This has been the common practice in ski making for many years.) The cross-section of each edge 208 is a square 0.085 inch on each side. A further assumption is that the running surface 210 is to be a sheet of polyethylene of approximately 0.05 inch thick. (This again has been a common practice in the ski industry for many years.) The thickness of the top sheet 200, bottom sheet 202 and side sheets 204 are designated t1, t2 and t3 respectively, in the table that follows. The effect of the plastic top surface on ski weight is not included. The width dimension of the wood core is presumed to be three inches.

In studying this idealized model relative to the common prior art fiber reinforced plastic structure and the aluminum ski, we will assume that: (a) our fiber reinforced plastic has dimensions such as those shown in the table which follows later herein; (b) the core is made of wood; and (c) for the laminated fiber reinforced plastic ski and for the prior art aluminum laminated ski, the two side members 204 are non-existent.

In studying this same idealized model relative to the basic concept arrived at in the present invention. The side edges 208 and the bottom running surface 210 are considered to be the same as indicated above. Also, the core 206 is presumed to be made of wood having adequate structural strength in tension, compression and also in shear. The top and bottom structural sheets 200 and 202 are presumed to be of a relatively high strength steel (as indicated in the table below), but yet having the capability of being bent or formed as described previously herein with regard to the method of manufacture of the present invention. Since the preferred form of forming the top sheet 200 and the side sheets 204 is to form an inverted "U" cross section, the side plates 204 are presumed to be of the same material and thickness as the top sheet 200.

TABLE 1

| | | AL | FRP | Steel Box |
|---|---|---|---|---|
| Thickness, | $t_1$ (in) | .043 | .060 | .020–.015 |
| | $t_2$ | .033 | .030 | .015–.010 |
| | $t_3$ | 0 | 0 | .020–.015 |
| Young's Modulus, | $E_f$ (psi) | $10 \times 10^6$ | $5 \times 10^6$ | $30 \times 10^6$ |
| | $E_c$ | $1.8 \times 10^6$ | $1.8 \times 10^6$ | $1.8 \times 10^6$ |
| | $E_s$ | $30 \times 10^6$ | $30 \times 10^6$ | $30 \times 10^6$ |
| density, | $d_f$ (pci) | .101 | .066 | .284 |
| | $d_c$ | .023 | .023 | .017 |
| | $d_s$ | .284 | .284 | .284 |
| yield strength | $\sigma_f$ (psi) | $66 \times 10^3$ | $62 \times 10^3$ | $204 \times 10^3$ |
| | $\sigma_s$ | $260 \times 10^3$ | $260 \times 10^3$ | $260 \times 10^3$ |

where the subscripts designate the following: "f" designates sheets 200, 202 and 204; "c" designates core 206; and "s" designates edge members 108.

Next, in this analysis, the assumption was made that the overall weight and structural stiffness distribution along the length of the ski was to be comparable to those of the prior art skis which are presently accepted in today's ski market. This automatically dictated certain restraints on the thickness of the steel sheets 200 and 202 and also its strength characteristics. Further, to obtain the appropriate flexural stiffness distribution along the length of the ski, the vertical thickness dimension of the ski (i.e. which is the distance between the upper and lower surfaces of the top and bottom sheets 200 and 202, respectively) was in a sense dictated.

Figure 11:
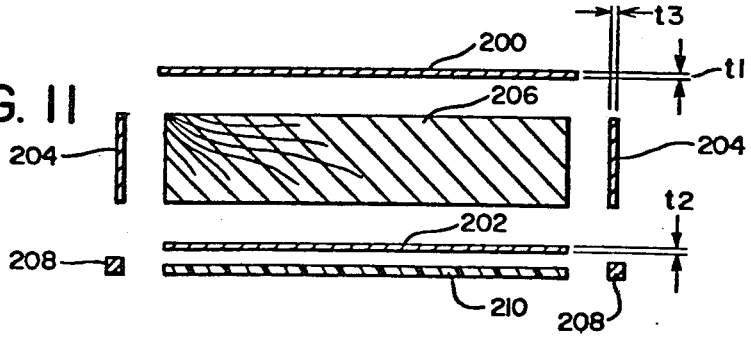
FIG. 11 is a sectional view of the component of an "ideal" ski presented for certain purposes of analysis of the prior art and of the present invention.

Based on these premises, and based upon the theorectical model shown in FIG. 11, certain general design critera were determined. Then a prototype ski was made in accordance with these preliminary calculations based upon this ideal model. Subsequent testing of this prototype led to further refinements in this analysis, and also to an analysis of the interrelation of the various factors which go into a performance of the ski. More specifically, the analysis was directed to the flexural stiffness, weight density, yield strength, and torsional stiffness. The results of this analysis are presented below, and to explain these, reference is made to FIGS. 12–15. (This analysis was performed initially with reference to the ski of the fourth embodiment where the side walls 144 are fixedly connected directly to the bottom steel sheet and to the edge members 138. Later this analysis was applied to the ski of the first embodiment where the side walls 33 are not fixedly connected to the bottom face 38 and to the edges 36, and there is very little difference in the results.

In making these analyses, two specific designs of the ski of the present invention were considered. First, consideration was given to a ski where the thickness of the steel sheet for the top sheet 200 and the two side members 204 was 0.020 inch, and the thickness of the bottom sheet 202 was 0.015 inch. In the second design the thickness of the top steel sheet 200 and the two side steel members 204 was 0.015 inch, and the thickness dimension of the steel bottom sheet 202 was 0.010 inch. Curves for both of these designs are given in FIGS. 12 and 18.

FIGS. 12–15 are graphs that indicate certain physical characteristics of the present day prior art aluminum laminated and fiber reinforced plastic laminated skis, and also of a preferred design of a ski made in accordance with the present invention. The curves presented are arrived at by theoretical analysis, but these curves were checked experimentally, and the appropriate data points are indicated on these graphs.

Figure 12:
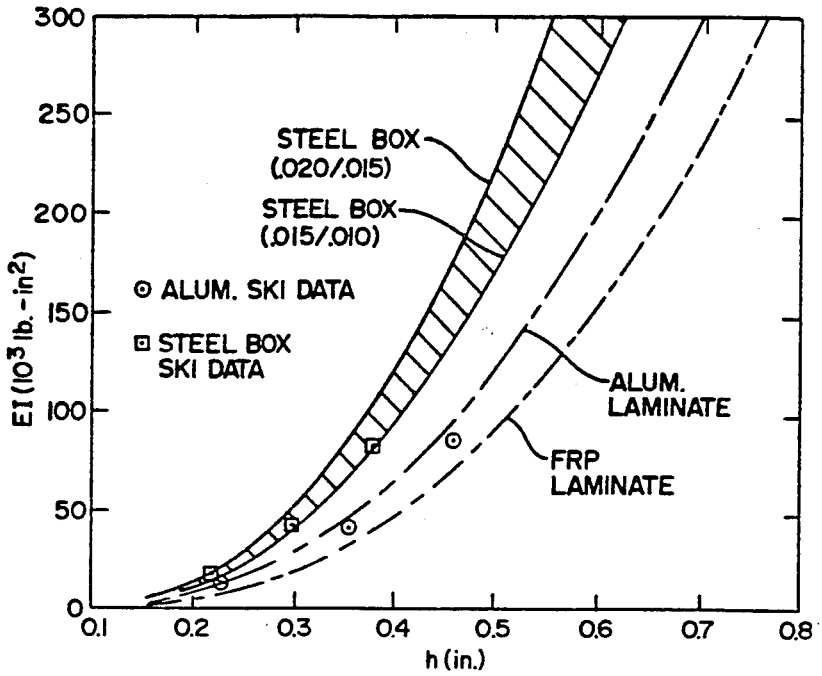
FIG. 12 is a graph plotting flexural stiffness against thickness of the ski, and showing the characteristics of the configuration of the present invention, compared with an aluminum laminated ski and a fiber reinforced plastic laminated ski.

FIG. 12 plots flexural stiffness against the vertical thickness dimension of the ski. Flexural stiffness is the resistance of the ski to bending along its longitudinal axis. It can be seen that the ski of the present invention is thinner for a given flexural stiffness than either the aluminum and fiber reinforced plastic designs. (The vertical thickness dimension is taken from the top surface of the sheet 200 to the bottom of the running surface 210.) The significance of this characteristic, relative to the weight distribution of the ski will become clearer by examining FIG. 13.

Figure 13:
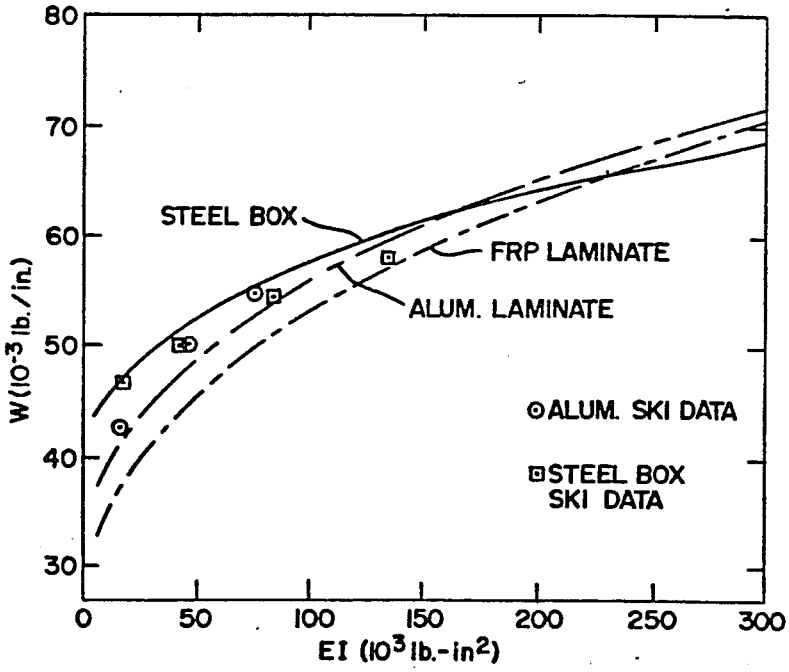
FIG. 13 is a graph plotting weight density against flexural stiffness, and comparing the same three ski configurations as in FIG. 12.

FIG. 13 plots the weight density of these ski section against flexural stiffness. The weight density is the weight per unit length of the ski. It can be seen that the weight density of both of the designs analyzed for the ski of the present invention is moderately higher than that of the two prior art skis studied for values of lower flexural stiffness. However, for higher levels of flexural stiffness, the weight density of the ski of the present invention actually becomes somewhat less than that of the two prior art skis studied. Thus, while the design of the ski of the present invention falls within a plus or minus 10% weight limitation relative to the design of the two prior art skis, the weight of the ski of the present invention is distributed quite differently from the two prior art skis studied. At low flexural stiffness (which exists nearer to the extreme ends of the ski), the weight density of the ski of the present invention is relatively higher. However, at higher flexural stiffness (which would occur closer to the midlength of the ski), the weight density of the ski of the present invention is relatively lower. The significance of this is that the weight distribution is such that the stability of the ski in straight downhill travel is enhanced, since the weight distribution places more of the weight at the ends of the ski, and less in the middle, relative to the prior art ski configurations.

In FIG. 14, the yield strength of the skis is plotted against flexural stiffness. It can be seen that for a given degree of stiffness, the two designs considered for the ski of the present invention have a relatively higher yield strength. While it may not be immediately evident why this occurs, further analysis produces what is believed to be a reasonable explanation. As illustrated in FIG. 12, for a given flexural stiffness, the ski of the present invention is relatively thin in its vertical thickness dimension. Thus, if a section of a ski of the present invention is flexed to a given curvature, and a comparable section of either of the two prior art skis studied (i.e. having the same length and flexural stiffness) is flexed to the same degree of curvature, the deformation of the steel sheets of the ski of the present invention (i.e. the compression of the top sheet 142 and the stretching of the lower sheet 136) is relatively less than the top and bottom layers of the comparable sections of the two prior art skis studied. This illustrates one of the unexpected benefits of the present invention, in that it alleviates to a larger extent one of the problems which was encountered (and is still encountered), relative to laminated aluminum skis, were deficiency in yield strength is often exhibited by bending in severe usage of the ski.

With reference to FIG. 15, torsional stiffness is plotted against flexural stiffness of the ski. It can be seen that for a given flexural stiffness, the ski of the present invention has greater resistance to torsional bending. (Torsional bending is the "twisting" of the planar surface of the ski along the length of its longitudinal axis.) The significance of this characteristic, in terms of practical operation of the ski of the present invention, is that this enables the ski to be made relatively flexible in terms of flexural stiffness so that the ski can adapt itself well to rather rough terrain. Yet, in executing a turn, the ski maintains a relatively untwisted configuration (in spite of the fact that the flexural stiffness is at a predetermined lower level) so the ski is well able to hold its edge in making a turn on icy surfaces where the holding of an edge is particularly difficult.

J. Analysis of Overall Design and Operating Characteristics of the Ski of the Present Invention in Comparison with Commonly Used Prior Art Skis Before discussing the specifics of the design and operating characteristics of the ski of the present invention, it is believed that it would be appropriate to discuss at least briefly some of the underlying considerations relating to the scaling of the ski.

In ski design, the problems of scaling remains somewhat of an art. That is to say, there are no steadfast rules by which skis of various sizes, within the same model, are designed for their stiffness and width. For scoping purposes, however, it is nonetheless possible to gain a general appreciation for the variations in width and length by considering the following very general rules of thumb. Please note, however, that these are only very general guidelines and are not to be considered universal laws regarding ski design.

Width scaling is simply a matter of maintaining a proportionality between the "model" skier's height and the average width of the ski's running surface. When a constant proportionality is kept between height and width, a constant proportionality between the force needed to angulate the skis and the skier's height is obtained.

Stiffness scaling is more difficult. Experience has proven that the overall stiffness coefficient K, defined as the force applied at mid-running surface needed to deflect the ski a unit distance, while supported at the ends of the running surface, can be a constant for all sizes of a given model. To determine the appropriate flexural stiffness EI, one must relate the overall stiffness coefficient to the distribution in EI along the ski's length. Typically, the EI distribution of a ski is a complicated function of length, making numerical integration of the bending formula necessary in order to obtain the deflection for a given loading. As an approximate guide, one can assume a guadratic distribution in EI given by:

$$EI(x)=EI_o(1-x/L_2)^2$$

where:

$EI_o$ is the flexural stiffness of mid-running surface, x is the distance from the mid-running surface point, and $L_2$ is the half running surface length.

Using this and assuming that the flexural stiffness at the end of the running surface $EI_f$(i.e. at $x=L_2$) is some well defined fraction of the center stiffness $EI_o$, given by $u=(EI_f/EI_o)^{\frac{1}{2}}$, the bending formula can be integrated analytically giving the following expression for K:

$$K=EI_o\cdot 2[L_1^3[u(1-\ln u)-(1+\ln u)]-L_1^2L_2(1-\ln u)+L_1L_2^2]^{-1}$$

where:

$$L_1=[L_2/(1-u)]$$

and where the symbol ln is used for the natural logarithm.

Figure 17:
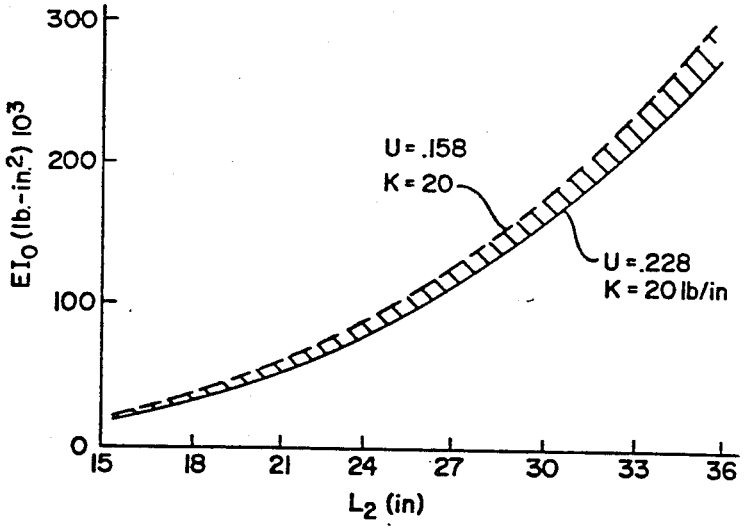
FIG. 17 is a graph illustrating the variation of flexural stiffness at the center point ($EI_o$) with half running surface length ($L_2$), where the overall stiffness coefficient K is at 20 lbs/inch.

Experience shows that the coefficient u can be about 0.158 for many ski types, and can be treated as a constant for all sizes. This means that $EI_f$(the flexural stiffness at the end contact portions) is 2.5% of $EI_o$ (the flexural stiffness at thickest midportion of the skis). Experience also shows that the stiffness coefficient K can be about 20 lb/in for many ski models and is generally in the range of 17 to 27 lb/in, with 15 to 30 lb/in being an extreme range. With these factors, $EI_o$ can be determined as a function of $L_2$, the half-running surface length. The result is plotted in FIG. 17, and allows the final definition of a sample design for the ski of the present invention.

Figure 18:
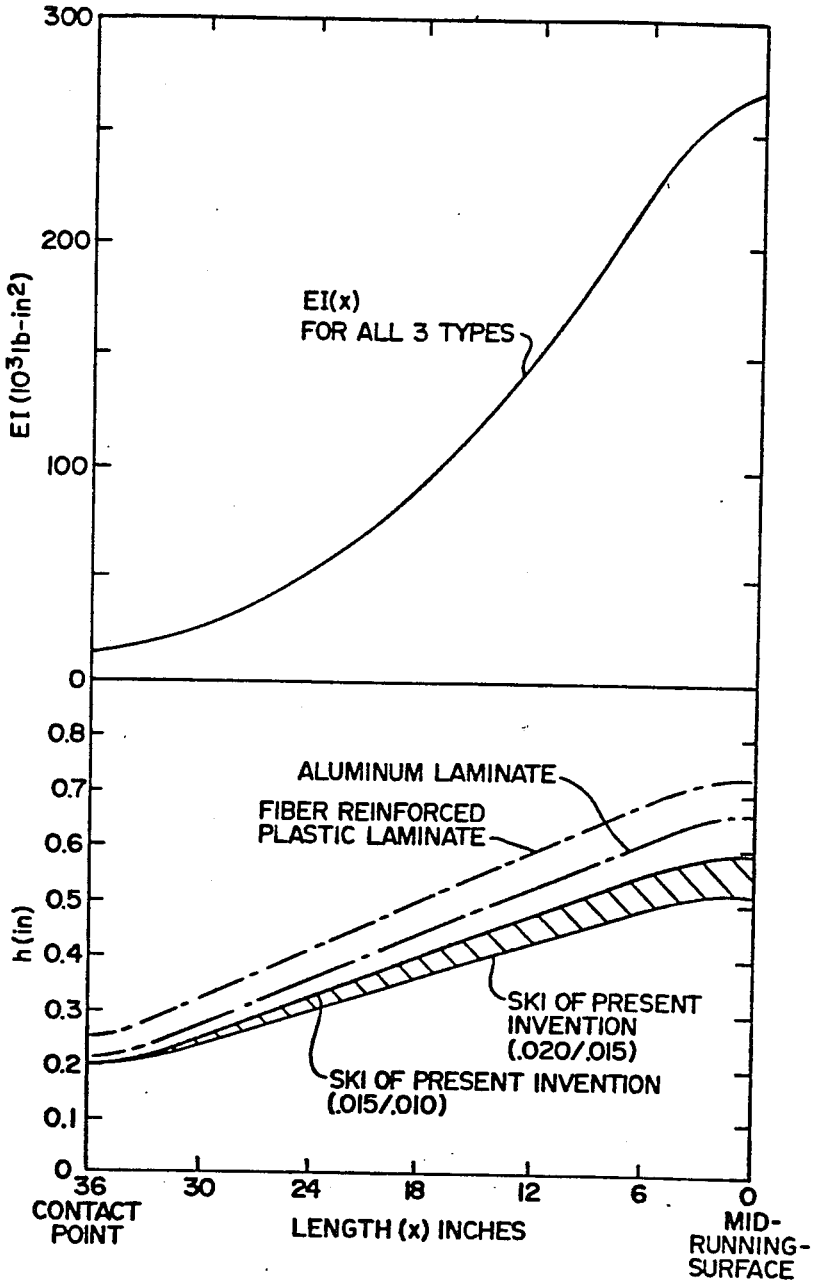
FIG. 18 is a graph illustrating in the top part of the graph an optimized flexural stiffness curve for a typical, high quality present day prior art 207 cm ski, and plotting the thickness dimension of the ski of the present invention along the length of the ski, compared to the aluminum laminate ski and fiber reinforced plastic ski.

The definition proceeds as follows. Because EI roughly varies with the square of h, the vertical thickness dimension, we begin by defining a thickness distribution that is roughly linear in length. This produces an EI distribution that is roughly quadratic in length, so that the foregoing rule for relating $EI_o$ to length and overall stiffness is appropriate. For any given length within the value limits of the graph of FIG. 17, the central and end EI values are given by FIG. 17. The corresponding end thickness values can be obtained from the graph of FIG. 12. These are used as a rough guide in producing the thickness profile shown in FIG. 18 for the 207 cm long ski ($L_2$=36 in.). FIG. 18 shows only the half length of the ski. This is because the ski can be considered symmetric about the mid-running surface for the purposes of this exposition.

We will now proceed with the assumption that a ski of an arbitrary length and weight will be selected to match the characteristics of present day skis now commonly in use. Further, an overall stiffness coefficient of 20 lbs/in will be presumed to be comparable to those skis which have been proven acceptable in the present day ski market, and this will allow determination of $EI_o$ from FIG. 17, with a tolerance of plus or minus 25% and, more desirably within 10%. We will also proceed on the assumption that this ski is to be used by a person of 150 pounds who has reasonably good skiing ability. A common prior art ski in present day use (i.e. the aluminum laminate or fiber reinforced plastic laminate as described previously) having a length of about 207 cm would have a total weight of between about 4.5 to 5 pounds, and a total ski weight of 4.5 pounds will be selected for purposes of this analysis.

Reference is now made to FIG. 18, which illustrates in the top part of the graph a flexural stiffness distribution curve which is at a maximum of about $270\times10^3$ lb-in$^2$ at the midlength of the ski, and a minimum of about $6\times10^3$ lb-in$^2$ at the end contact point. For ease of illustration, only one-half of the ski is shown.

At the lower part of the graph of FIG. 18, there are four curves, derived by calculation, illustrating the vertical thickness dimension along the length of the two designs of the ski of the present invention, the aluminum laminated ski, and a fiber reinforced plastic ski. Each of these is assumed to have the same flexural stiffness, as indicated by the flexural stiffness curve at the top of the graph. It can be seen that the ski of the present invention, in order to match the flexural stiffness of the two present day prior art skis considered, has an overall lesser thickness dimension. Further, it can be seen that since the flexural stiffness varies approximately to the square of the thickness, and since the desired distribution of flexural stiffness is closer to a quadratic function, the slope of the thickness curve is substantially constant along the length of the ski, although it is flattened at the midlength so that there is not an abrupt change of curvature at the middle portion of the ski.

Also, it is to be understood that the maximum height dimension for the ski of the present invention, as shown in the graph of FIG. 18 is for a 207 cm ski.

Figure 19:
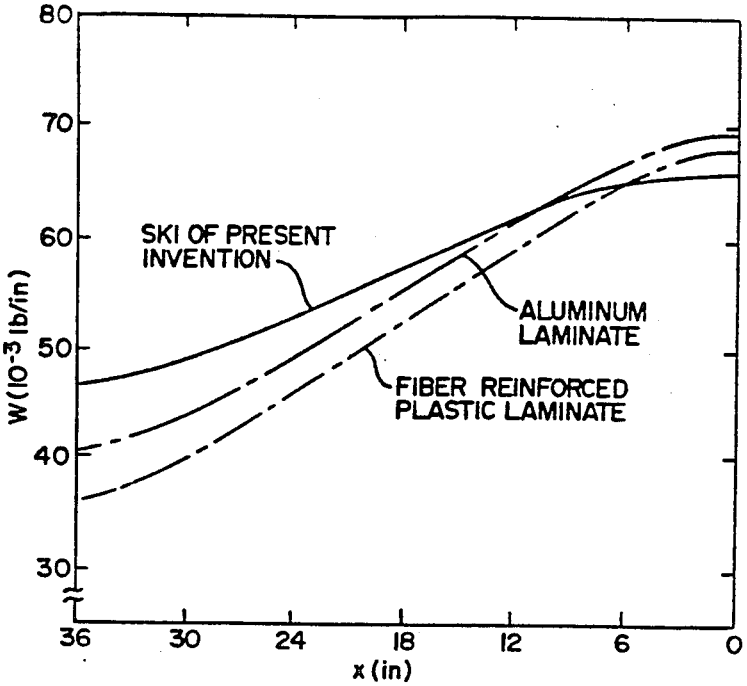
FIG. 19 is a graph plotting the weight distribution of the ski of the present invention in comparison with an aluminum laminate ski and fiber reinforced plastic 207 cm ski along the length of the skis.

Consideration is now given to the weight density which is illustrated in FIG. 19. Since we have proceeded on the initial assumption that the weight of the ski of the present invention would be, for a given length, approximately the same as the weight of either of the two prior art skis under consideration, we are concerned at this point as to the allocation of the weight along the length of the ski. It can be seen from the graph of FIG. 19 that the weight density of the ski of the present invention is relatively higher at the end portions of the ski, and relatively less at the midportion of the ski. The lines shown on the graph of FIG. 19 were derived analytically, and actual practice has shown that the weight of the ski of the present invention is actually somewhat less than that indicated in the graph of FIG. 19. It is believed that this particular weight distribution of the present invention contributes substantially to the performance of the ski in downhill travel (i.e. making the ski of the present invention "perform like a long ski" in straight downhill travel).

Figure 20:
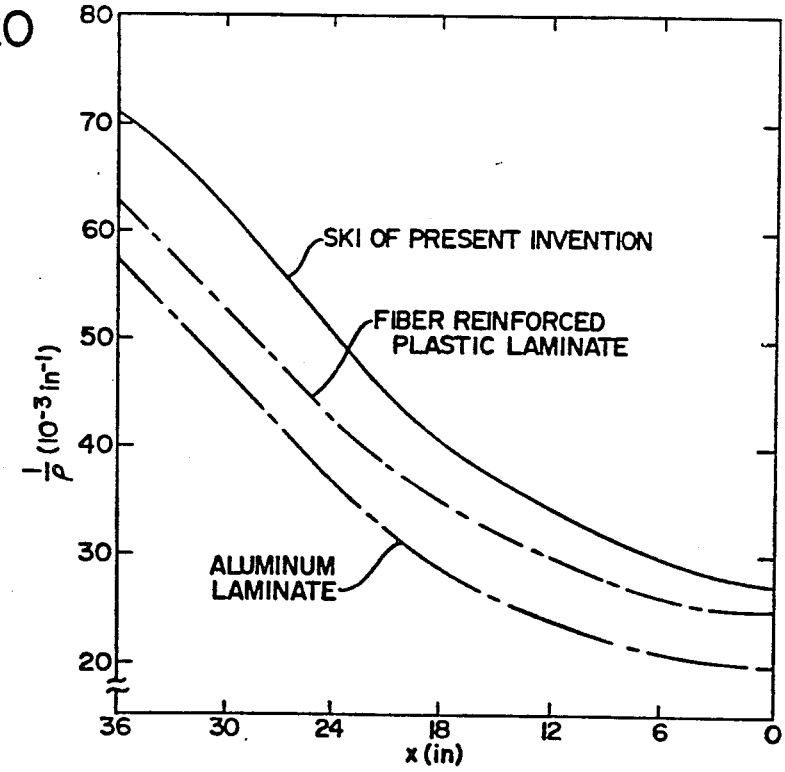
FIG. 20 is a graph plotting the yield strength of the ski along the length of the ski, again comparing the ski of the present invention with that of the fiber reinforced plastic laminate and the aluminum laminate 207 cm ski.

Next, with reference to FIG. 20, consideration is given to the yield strength of the ski of the present invention relative to the two prior art skis under consideration. The crucial feature relative to strength of the ski in normal service is the minimum radius to which the ski can be bent before retaining a permanent set. It can be seen from an examination of FIG. 20 that the yield strength of the ski of the present invention is greater along the length of the entire ski, in comparison with the two prior art skis under consideration.

Finally, reference is made back to FIG. 15 which plots torsional stiffness against flexural stiffness. Since the flexural stiffness distribution and values of the ski of the present invention and the two prior art skis under consideration is presumed to be the same for all three types of skis being considered, the values plotted on the graph of FIG. 15 would be representative in comparing the torisonal stiffness of these skis at any particular location along the ski length. It can be seen that the torisonal stiffness of the ski of the present invention substantially exceeds that of the two prior art skis. This contributes to the ability of the ski of the present invention to hold its edge in a turning maneuver.

Figure 2A:
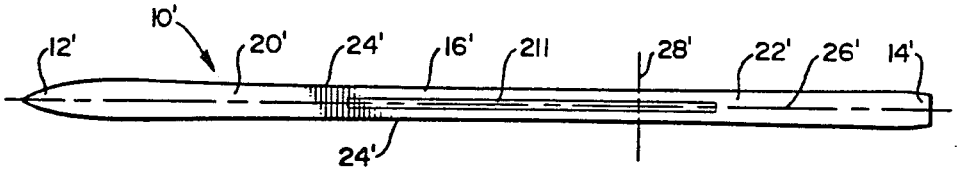
FIG. 2A is a top plan of a ski, such as shown in FIG. 1, but with a modified top structural sheet.

With reference to FIG. 12, it is apparent that as the overall length of the ski becomes shorter, the maximum flexural stiffness at the center of the ski becomes less, which in turn means that for a given thickness dimension of the upper and lower sheets 142 and 136, the vertical thickness dimension of the ski becomes less. However, as the ski becomes very short (e.g. possibly as short as one meter for a small child's skis) it is apparent that the vertical thickness dimension would become so small that it would be difficult to fasten the bindings to the ski. Accordingly, the thickness dimension could be made somewhat greater in either of two ways. First, the thickness dimension of the top and bottom sheets 142 and 136 could be made less. Second longitudinally extending sections of the upper and lower sheets 142 and 136 could be removed or cut out, so that there is essentially less material forming the cross-section of the upper and lower sheets 142 and 136. Such a configuration is illustrated in FIG. 2A, where the ski 10' has its top sheet 32' formed with a longitudinal slot 211. A similar slot could be formed in the bottom sheet 38'.

K. Significant Design Parameters of the Present Invention

It is to be understood that the various numerical limitations and tolerances presented herein are to be interpretted in light of the following.

The design criteria given herein are for a ski which is to be used by a skier of at least intermediate ability, with this ski being designed for all around performance. In other words, the ski would perform quite well for straight donwhill skiing, and have comparable performance for making sharp turns. However, it is to be understood that when the ski is being designed for special applications, there would be departures from what is given herein as the optimized design criteria.

For example, let it be assumed that the ski is being designed for downhill racing or a giant slalom, where sharp turning is not required, but where the ski should be optimized for fast gliding (i.e. low resistance gliding). Under these conditions, quite likely the thickness of the metal sheets (i.e. of both of the sheets, or of either the top or bottom sheets) would be made relatively greater to give the ski a somewhat greater weight. Further, it would be expected that the vertical thickness dimension of the skis would be relatively smaller at the extreme ends. Thus, the forward part of the ski would have less flexural stiffness and be able to deflect more readily when encountering even moderately bumpy terrain. It is known that this generally allows the ski to glide faster.

On the other hand, let it be assumed that the ski is being optimized for a slalom course where relatively fast tight turning is required. In this instance, the ski would be made somewhat lighter, so that desirably the upper and lower steel sheets would be approximatley no greater than 0.015 inch thickness. Further, the end portions of the ski might have an overall relatively greater thickness dimension than the skis optimized for all around performance. The reason for this is that the end portions of the skis would have somewhat greater flexural stiffness than usual to optimize performance in sharp turning maneuvers.

In accordance with the earlier discussion herein, the ski of the present invention, designed for optimum all around performance, has a stiffness coefficient K of about 20 lbs/inch, with a broader range of stiffness coefficient being between 17 to 27 lbs/inch, with 15 to 30 lbs/inch being the outermost range. Further, the distribution of flexural stiffness along the length of the ski is along the line which follows, with reference to the graph of FIG, 18, a flexural stiffness distribution pattern within about plus or minus one quarter of the flexural distribution stiffness line of the graph of FIG. 18.

With regard to the upper and lower sheets 200, 202, as indicated previously herein, in the preferred embodiments, the upper steel sheet 200 would have a thickness between about 0.015 and 0.020 inch, while the thickness of the bottom steel sheet 202 would be between about 0.010 and 0.15 inch. However, it is to be recognized that flexural stiffness is related both to thickness of the upper and lower sheets 200, 202 (and to a lesser extent to the side member 204), but also to the total thickness dimension of the ski. The relationship is such that, in general, flexural stiffness is roughly proportional to the thickness of the upper and lower sheets 200, 202, and directly proportional to the square of the thickness dimension of the ski. In interpreting the claims that define the scope of the present invention, it is to be recognized that within the limitations specified in the claims, the thickness dimension of the sheets 200, 202 and the thickness dimension of the ski itself could be varied relative to one another to produce a flexural stiffness pattern within the desired limits. (For example, the thickness dimension of the ski could be increased, and the thickness of the sheets 200 and 202 decreased, while maintaining substantially the same flexural stiffness.)

Also, in interpreting the claims of the present invention relative to the thickness dimension of the ski, the thickness of the lower running surface 210 is presumed to be 0.05 inch, and this is included in the thickness dimension of the ski. Thus, if the thickness dimension of the running surface 210 is changed from that 0.05 value, the claims are to be interpreted to allow for that change.

Further, it is to be recognized that in interpreting the claims of the present invention, if the ski is to be a special purpose ski so that design criteria will depart from the criteria for the ski design for all around performance (as discussed above), the claims should be interpreted to recognize that the design parameters (e.g. flexural stiffness distribution) would be varied to accommodate the special requirements for that ski.

With the flexural stiffness distribution being given in FIG. 18, for a ski of a given length, the optimized thickness dimension of the ski can be determined with reference to FIG. 12. It will be noted from examining the graph of FIG. 12 that the thickness dimension of the ski will vary, depending upon the thickness dimensions of the sheets 200 and 202. Within the broader design parameters of the present invention, it is anticipated that the thickness dimension of the ski will be, relative to the thickness dimensions of the sheets 200 and 202, within about twelve percent of the thickness dimension derived from the graph of FIG. 12 for a flexural stiffness of a given value and for sheet thickness (i.e. thickness of the sheets 200, 202) of a given value. In the preferred form, the thickness dimension would be within five percent of the value so derived from the graph of FIG. 12.

With the ski of the present invention being constructed in accordance with the design parameters outlined above, it has been found that the benefits of the present invention are achieved. More specifically, the ski will be more resistant to torsional bending, relative to flexural stiffness, as illustrated in the graph of FIG. 14. Further, the ski will have a desirable weight distribution, as illustrated the graph of FIG. 19. Also, the ski will have the improved ultimate yield strength relative to flexural stiffness of the ski, as illustrated in the graph of FIG. 20.

L. Fifth and Sixth Embodiments of the Present Invention

Figure 21:
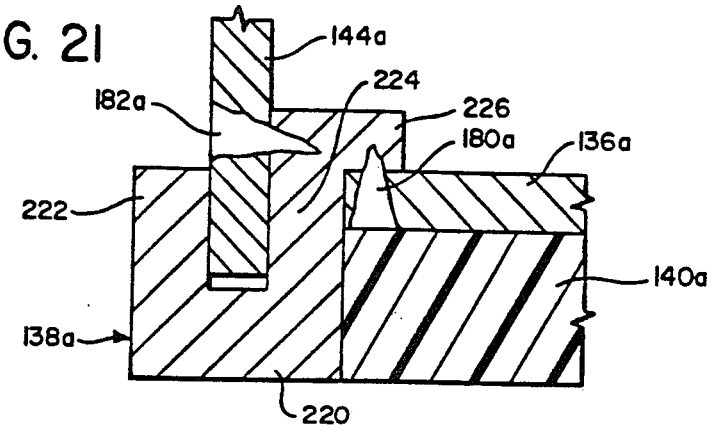
FIG. 21 is a view similar to FIG. 10, illustrating a fifth embodiment for the edge part of the present invention.

With reference to FIG. 21, there is shown a fifth embodiment. Components of this fifth embodiment which are similar to components of the fourth embodiment will be given like numerical designations, with an "a" suffix distinguishing those of the fifth embodiment. This fifth embodiment differs from the fourth embodiment essentially in the configuration of the edge member **138*a* and how it joins to the side sheets 144*a* and the bottom sheet 136*a***.

The edge member **138*a* has a generally U-shaped configuration and comprises a lower horizontal portion 220, and outside leg 222, and an inside leg 224. The outside leg 222 extends a moderate distance above the bottom edge of the sheet 144*a*. The inside leg 224 extends upwardly beyond the upper surface of the sheet 136*a*, and has an outwardly protruding arm 226 which extends over the outer edge of the sheet 136*a*. The weld points 180*a* between the sheet 136*a* and the edge member 138*a* are oriented vertically from the outer edge of the sheet 136*a* upwardly. The weld locations 182*a* by which the side sheet 144*a* is welded to the edge member 138*a*** are, as in the first embodiment, directed horizontally from the outside of the ski.

Figure 22:
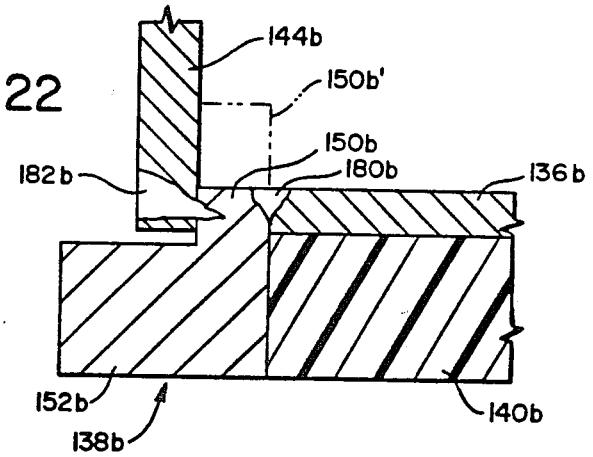
FIG. 22 is a view similar to FIG. 21, illustrating a sixth embodiment for the edge part of the present invention.

With reference to FIG. 22, there is shown a sixth embodiment. Components of this sixth embodiment which are similar to components of the fourth and fifth embodiments will be given like numerical designations, with a "b" suffix distinguishing those of the third embodiment. There are the side sheets **144*b* and bottom sheet 136*b*. The edge member 138*b* has a laterally extending edge portion 152*b* and an upstanding leg portion 150*b*. However, the leg portion 150*b* extends upwardly between the inside edge of the sheet 136*b* and the lower inside surface of the sheet 144*b*. The weld locations 180*b* are applied vertically downwardly to attach the sheet 136*b* to the edge member 138*b*. As in the previous embodiment, the weld locations 182*b* are directed laterally to join the lower edge portion of the sheet 144*b* to the leg portion 150*b***. As an option, the leg 150*b* could be extended upwardly, and this is indicated in broken lines at 150*b'*.

It is obvious that other changes could be made, without departing from the scope of the present invention.

I claim:

1. A ski particularly adapted for effective travel over a snow surface, said ski comprising: a front end, a rear end, a middle portion, a major longitudinal axis extending along a lengthwise dimension of said ski, a minor transverse axis perpendicular to said longitudinal axis, and a vertical thickness axis, said ski having two side surfaces, each of which curves moderately inwardly in a generally concave curve from the front and rear ends toward the middle portion, said ski further comprising:

a. a core structure;

b. an outer steel box means, comprising:

1. an upper steel sheet having two edge portions;

2. a lower steel sheet have two edge portions;

3. two steel side wall sheets defining side walls positioned on opposite sides of said upper and lower sheets which with said upper and lower sheets and said core structure complete a box structure, with upper edge portions of each of said side wall sheets being rigidly connected to related side edge portions of the upper sheet, said box means being arranged in a manner that said upper sheet is positioned at a level at least as high as the upper edge portions of the side wall sheets, and said side wall sheets being substantially planar with lower edge portions thereof extending substantially vertically downwardly;

4. said upper, lower and side wall sheets having substantially constant material thickness dimensions from the front end to the rear end;

c. said core structure being positioned between, and adhesively bonded to said upper and lower sheets and having substantially planar upper and lower contact surfaces which extend along and are bonded to said upper and lower sheets, respectively, throughout a major portion of the longitudinal axis and along substantial bonded surfaces areas thereof;

d. a running surface member adhesively bonded to a lower surface of said lower sheet;

e. a pair of metal edge members formed separately from said upper, lower and side sheets, said edge members rigidly connected to opposite lower edge portions of said box structure, wherein said box structure comprises the upper and lower sheets in combination with the side walls and the core to determine the torsional and flexural characteristics of the ski;

f. said upper and side wall sheets having material thickness dimensions between two-hundredths to one and one-half hundredths of an inch, said lower sheet having a material thickness dimension between about one and one-half hundredths to one-hundredths of an inch;

g. said ski having a vertical thickness dimension measured from a top surface of said upper sheet to a lower surface of said lower sheet, said vertical thickness dimension being at a maximum at the middle portion of the ski and diminishing toward the front and rear ends of the ski, said vertical thickness dimension at the middle portion of the ski being dependent on a half length dimension of the ski measured from a center location of the ski equidistant between front and rear contact points to one of said rear front and rear contact points, in accordance with values as follows:

| half length dimension in inches | vertical thickness dimension at center of ski in inches |
|---|---|
| 36 | 0.43–0.64 |
| 30 | 0.33–0.54 |
| 24 | 0.24–0.38 |
| 18 | 0.18–0.28 |

with the vertical thickness dimension at the center of the ski relative to other half length dimensions of the ski lying within a range defined by two curves passing through said thickness dimension upper and lower limits relative to the half length dimensions of 36 inches, 30 inches, 24 inches, and 18 inches.

2. The ski as recited in claim 1, wherein said vertical thickness dimension at the middle portion of the ski, relative to the half length dimension of the ski is in accordance with values as follows:

| half length dimension in inches | vertical thickness dimension at center of ski in inches |
|---|---|
| 36 | 0.46–0.60 |
| 30 | 0.36–0.51 |
| 24 | 0.26–0.37 |
| 18 | 0.20–0.27 |

3. The ski as recited in claim 1, wherein said vertical thickness dimension at the middle portion of the ski, relative to the half length dimension of the ski is in accordance with values as follows:

| half length dimension in inches | vertical thickness dimension at center of ski in inches |
|---|---|
| 36 | 0.48–0.57 |
| 30 | 0.38–0.48 |
| 24 | 0.28–0.34 |
| 18 | 0.21–0.25 |

4. The ski as recited in claim 1, wherein said upper, lower and side sheets are made of a high strength steel, having a yield strength at least as great as about $200\times10^3$ lb/in$^2$.

5. The ski as recited in claim 4, wherein the yield strength of the upper, lower and side sheets is at least approximately $250\times10^3$ lb/in$^2$.

6. The ski as recited in claim 1, wherein said side sheets are formed integrally with said upper sheet.

7. The ski as recited in claim 1, wherein said core structure is made from wood having adequate resistance to sheer so as to be able to transmit forces between said upper and lower sheets.

8. The ski as recited in claim 1, wherein said upper sheet is connected to said lower sheet primarily through said core structure which transmits forces between said upper and lower sheets, with the side sheets not having any substantial direct load bearing connection with said lower sheet.

9. The ski as recited in claim 1, wherein the upper and lower edges of the side sheets are fixedly connected to edge portions of both said uipper sheet and said lower sheet.

10. The ski as recited in claim 1, wherein each of said edge members comprises in cross-section:

a. a main body portion having a first lower surface, a laterally and outwardly facing second surface, and a laterally and inwardly facing third surface, said first and second surfaces forming an outer lower edge of the edge member, and said third surface abutting related edge surface portions of said lower steel sheet and said running surface member;

b. a first flange fixidly connected to, and extending inwardly from, an upper inner edge portion of said main body portion, said first flange having a lower surface being positioned above and bonded to a related upwardly facing edge surface portion of the said lower sheet.

11. The ski as recited in claim 10, wherein said edge member further comprises a second flange, fixidly connected to and extending upwardly from an upper outer edge portion of said main body portion, said second flange having an inwardly facing lateral surface engaging a lower outwardly facing lateral surface portion of a related one of said side sheets.

12. The ski as recited in claim 11, wherein lower edge portions of said core structure are formed with recesses to receive the first flanges of the two edge members.

13. The ski as recited in claim 10, wherein lower edge portions of said core structure are formed with recesses to receive the first flanges of the two edge members.

14. The ski as recited in claim 1, wherein:

a. said upper, lower and side sheets are made of a high strength steel, having a yield strength at least as great as about $200\times10^3$ lb/in$^2$; and b. said core structure is made from wood having adequate resistance to sheer so as to be able to transmit forces between said upper and lower sheets.

15. The ski as recited in claim 14, wherein:

a. said upper sheet is connected to said lower sheet primarily through said core structure which transmits forces between said upper and lower sheets, with the side sheets not having any substantial direct load bearing connection with said lower sheet.

16. The ski as recited in claim 14, wherein each of said edge members comprises in cross-section:

a. a main body portion having a first lower surface, a laterally and outwardly facing second surface, and a laterally and inwardly facing third surface, said first and second surfaces forming an outer lower edge of the edge member, and said third surface abutting related edge surface portions of said lower steel sheet and said running surface member;

b. a first flange fixidly connected to, and extending inwardly from, an upper inner edge portion of said main body portion, said first flange having a lower surface being positioned above and bonded to a related upwardly facing edge surface portion of the said lower sheet.

17. The ski as recited in claim 16, wherein said edge member further comprises a second flange, fixidly connected to and extending upwardly from an upper outer edge portion of said main body portion, said second flange having an inwardly facing lateral surface engaging a lower outwardly facing lateral surface portion of a related one of said side sheets.

18. The ski as recited in claim 14, wherein the yield strength of the upper, lower and side sheets is at least approximately $250\times10^3$ lb/in$^2$.

19. The ski as recited in claim 18, wherein said upper sheet is connected to said lower sheet primarily through said core structure which transmits forces between said upper and lower sheets, with the side sheets not having any substantial direct load bearing connection with said lower sheet.

20. The ski as recited in claim 18, wherein each of said edge members comprises in cross-section:

a. a main body portion having a first lower surface, a laterally and outwardly facing second surface, and a laterally and inwardly facing third surface, said first and second surfaces forming an outer lower edge of the edge member, and said third surface abutting related edge surface portions of said lower steel sheet and said running surface member;

b. a first flange fixidly connected to, and extending inwardly from, an upper inner edge portion of said main body portion, said first flange having a lower surface being positioned above and bonded to a related upwardly facing edge surface portion of the said lower sheet.

21. The ski as recited in claim 20, wherein said edge member further comprises a second flange, fixidly connected to and extending upwardly from an upper outer edge portion of said main body portion, said second flange having an inwardly facing lateral surface engaging a lower outwardly facing lateral surface portion of a related one of said side sheets.

* * * * *